US006814483B2

(12) United States Patent
Watanabe et al.

(10) Patent No.: US 6,814,483 B2
(45) Date of Patent: Nov. 9, 2004

(54) SELF-WINDING TIMEPIECE HAVING TRAIN WHEEL SETTING APPARATUS

(75) Inventors: Mamoru Watanabe, Chiba (JP); Shigeo Suzuki, Chiba (JP); Takashi Takahashi, Chiba (JP); Takeshi Tokoro, Chiba (JP); Katsuyoshi Takizawa, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/716,114

(22) Filed: Nov. 18, 2003

(65) Prior Publication Data

US 2004/0130972 A1 Jul. 8, 2004

(30) Foreign Application Priority Data

Nov. 20, 2002 (JP) ..... 2002-337024

(51) Int. Cl.[7] ..... G04B 15/00; G04B 25/02; G04B 5/00

(52) U.S. Cl. ..... 368/127; 368/148; 368/207

(58) Field of Search ..... 368/124, 127, 368/140, 147–148, 206–208

(56) References Cited

U.S. PATENT DOCUMENTS 3,901,019 A * 8/1975 Kocher et al. ..... 368/148
4,213,293 A * 7/1980 Mabuchi et al. ..... 368/152
4,500,213 A * 2/1985 Grimm ..... 368/208
5,867,454 A * 2/1999 Takahashi et al. ..... 368/148
6,441,516 B1 * 8/2002 Kaelin et al. ..... 310/36
6,485,172 B1 * 11/2002 Takahashi et al. ..... 368/148

* cited by examiner

*Primary Examiner*—Vit W. Miska
(74) *Attorney, Agent, or Firm*—Adams & Wilks

(57) ABSTRACT

To provide a self-winding timepiece having a thin and small-sized movement in which a train wheel setting apparatus for setting a balance with hairspring is efficiently arranged at the movement. A self-winding timepiece includes a main plate, a time indicating wheel, a winding stem and a switching apparatus. A movement barrel complete is arranged on a top side of the main plate and arranged to overlap a main plate reference horizontal axis line between a first region and a fourth region. A balance with hairspring is arranged on the top side of the main plate and arranged to overlap the main plate reference horizontal axis line between a second region and a third region. The switching apparatus is arranged on a back side of the main plate. A train wheel setting apparatus includes a train wheel setting portion for setting the balance with hairspring by penetrating the main plate. A portion of the train wheel setting portion of the train wheel setting apparatus for setting the balance with hairspring is disposed in the second region and a rotating center of the train wheel setting apparatus is disposed in the second region.

5 Claims, 20 Drawing Sheets

SELF-WINDING TIMEPIECE HAVING TRAIN WHEEL SETTING APPARATUS

BACKGROUND OF THE INVENTION

1. Field of the Invention

The present invention generally relates to a self-winding timepiece having a train wheel setting apparatus. Particularly, the invention relates to a self-winding timepiece having a train wheel setting apparatus operated by rotation of a setting lever and enabling to comprise small-sized and/or thin-sized formation of a movement.

2. Description of the Prior Art (1) Conventional Self-winding Timepiece Disclosed in Patent Literature 1

A conventional self-winding timepiece includes a main plate, a center wheel & pinion, a movement barrel complete, an escapement speed control apparatus, a switching apparatus, a dial and an oscillating weight. The movement barrel complete is arranged on a side of the main plate opposed to the dial and is provided with a rotating center in a first region. An escape wheel & pinion and a pallet fork are arranged on the side of the main plate opposed to the dial and are provided with rotating centers in a third region. A balance with hairspring (70) is arranged on the side of the main plate opposed to the dial and is arranged to overlap a main plate reference vertical axis line between the third region and a fourth region. A pivoting center of a setting lever and a pivoting center of a yoke are arranged on the side of the main plate opposed to the dial and are disposed in the second region. A self-winding mechanism includes the oscillating weight, a pawl lever and the like. A date indicator is arranged on the side of the dial plate of the main plate (for example, refer to patent literature 1).

<Patent Literature 1>

JP-A-10-104364 (pages 4 through 6, FIG. 1)

However, according to the conventional self-winding timepiece, the self-winding mechanism including the oscillating weight, the pawl lever and the like is arranged above a train wheel mechanism and therefore, it is difficult to thin the movement.

Further, according to the conventional self-winding timepiece, the switching apparatus and the balance with hairspring are arranged to be remote from each other and therefore, it is difficult to arrange a train wheel setting apparatus for setting the balance with hairspring at the movement.

SUMMARY OF THE INVENTION

It is other object of the invention to provide a self-winding timepiece having a thin and small-sized movement.

It is other object of the invention to provide a self-winding timepiece efficiently arranged with a train wheel setting apparatus for setting a balance with hairspring at a movement.

A self-winding timepiece of the invention includes a main plate comprising a base place of a movement, a time indicating wheel rotated with a rotating center thereof disposed at the main plate for indicating time information, a movement barrel complete and a clutch wheel for correcting the time information, a switching apparatus for determining a position in an axis line direction of the movement barrel complete, and a dial for indicating the time information along with the time indicating wheel. Here, the time indicating wheel is, for example, a minute indicator. The switching apparatus includes, for example, a setting lever, a yoke and the like. According to the self-winding timepiece of the invention, when a main plate reference vertical axis line passing the rotating center of the time indicating wheel and substantially in parallel with a center axis line of the winding stem and a main plate reference horizontal axis line passing the rotating center of the time indicating wheel and orthogonal to the main plate reference vertical axis line are defined at the main plate, the main plate is provided with a first region disposed on one side of the main plate reference vertical axis line and on a side of the main plate reference horizontal axis line proximate to the winding stem, a second region disposed on other side of the main plate reference vertical axis line and on the side of the main plate reference horizontal axis line proximate to the winding stem, a third region disposed on other side of the main plate reference vertical axis line at which the second region is present and on a side of the main plate reference horizontal axis line remote from the winding stem, and a fourth region disposed on the one side of the main plate reference vertical axis line at which the first region is present and on the side of the main plate reference horizontal axis line remote from the winding stem.

The self-winding timepiece of the invention includes a movement barrel complete arranged on a side of the main plate opposed to the dial and arranged to overlap the main plate reference horizontal axis line between the first region and the fourth region, a balance with hairspring arranged on the side of the main plate opposed to the dial and arranged to overlap the main plate reference horizontal axis line between the second region and the third region, and a self-winding mechanism arranged on the side of the main plate opposed to the dial for winding a mainspring of the movement barrel complete. According to the self-winding timepiece of the invention, the switching apparatus is arranged on a side of the main plate at which the dial is present and a train wheel setting apparatus operated by operating the switching apparatus is arranged on the side of the main plate at which the dial is present. The train wheel setting apparatus includes a train wheel setting portion for setting a balance with hairspring by penetrating the main plate. The self-winding timepiece of the invention is characterized in that on the side of the main plate opposed to the dial, a portion of the train wheel setting portion of the train wheel apparatus for setting the balance with hairspring is disposed in the second region and on the side of the main plate at which the dial is present, a rotating center of the train wheel setting apparatus is disposed in the second region. By the constitution, the small-sized and thin train wheel setting apparatus can be integrated to the main plate and a small-sized and thin self-winding timepiece can be realized.

According to the self-winding timepiece of the invention, it is preferable that the movement barrel complete including the balance with hairspring comprising a power source of the timepiece is arranged to overlap the main plate reference horizontal axis line between the first region and the fourth region. By the constitution, the movement barrel complete having a large size can be integrated to the main plate and therefore, a self-winding timepiece having large mainspring torque and having a long duration time period can be realized.

According to the self-winding timepiece of the invention, it is preferable to further include a center wheel & pinion arranged on the side of the main plate opposed to the dial and rotated by rotation of the movement barrel complete, a third wheel & pinion arranged on the side of the main plate opposed to the dial and rotated by rotation of the center wheel & pinion and a second wheel & pinion arranged on the side of the main plate opposed to the dial and rotated by rotation of the third wheel & pinion and operated for indicating a second, the time indicating wheel is arranged on the side of the main plate at which the dial is present and comprised to rotate by rotation of the third wheel & pinion and a rotating center of the center wheel & pinion and a rotating center of the third wheel & pinion are disposed in the fourth region. By the constitution, the movement barrel complete having a large size can be integrated to the top side of the main plate. Further, since the time indicating wheel is arranged on the side of the main plate at which the dial is present, the timepiece can be thinned.

According to the self-winding timepiece of the invention, it is preferable to further include an escape wheel & pinion arranged on the side of the main plate opposed to the dial and having a rotating center in the third-region and a pallet fork arranged on the side of the main plate opposed to the dial and having a pivoting center in the third region.

Further, according to the self-winding timepiece of the invention, it is preferable that the self-winding mechanism includes a switching transmission wheel comprised to input rotation in two directions of an oscillating weight and output rotation in one direction thereof and the switching transmission wheel is arranged to overlap the main plate reference vertical axis line between the third region and the fourth region. Since comprised in this way, according to the self-winding timepiece of the invention, a train wheel apparatus, an escapement speed control apparatus, the switching apparatus, the self-winding mechanism and the train wheel setting mechanism are arranged without wasting a space. Therefore, a small-sized and thin self-winding timepiece can be realized by the invention.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

Figure 1:
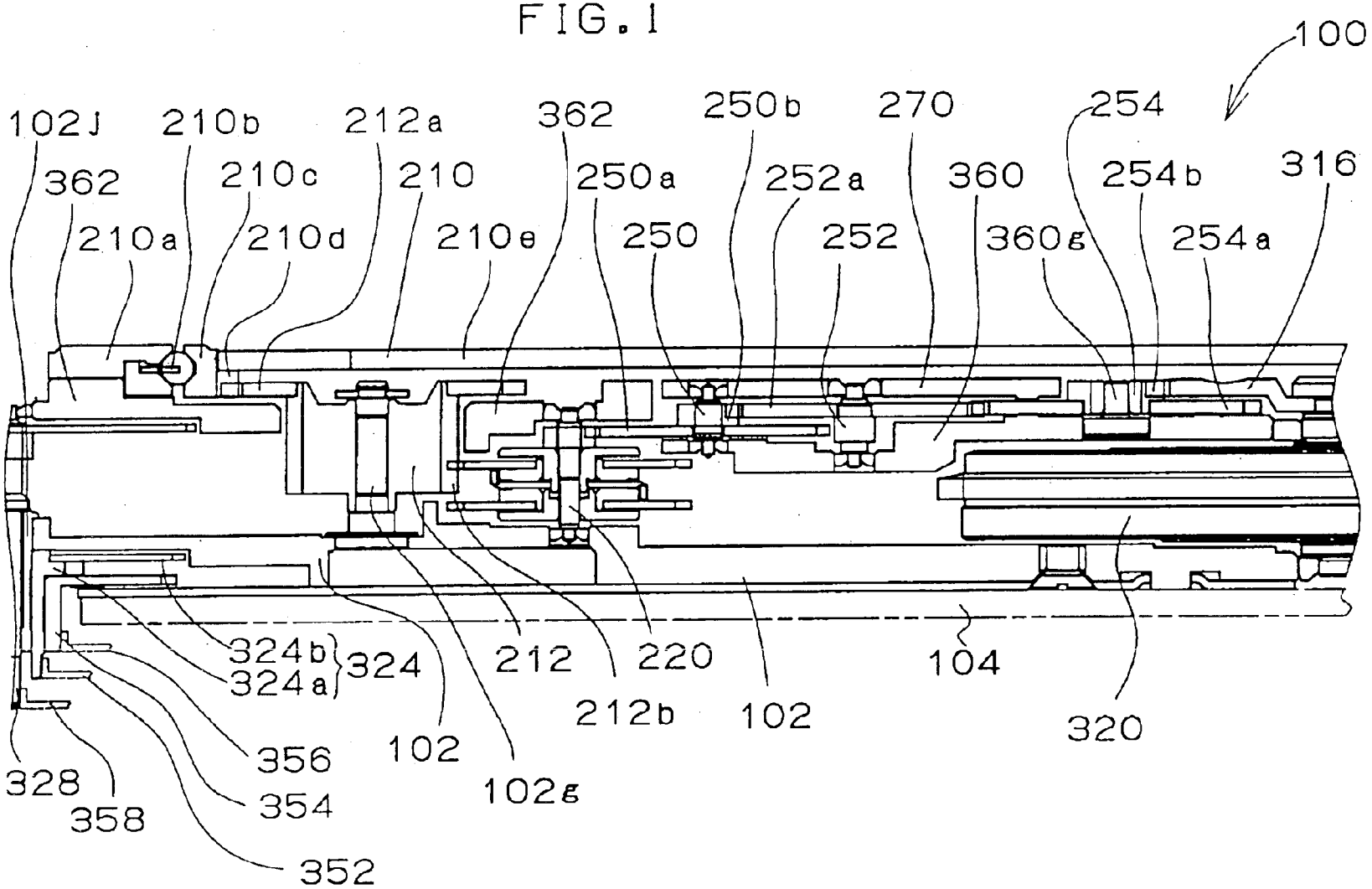
FIG. 1 is an outline partially sectional view showing a self-winding mechanism including an oscillating weight, a first intermediate wheel and a switching transmission wheel according to an embodiment of a self-winding timepiece of the invention.
Figure 2:
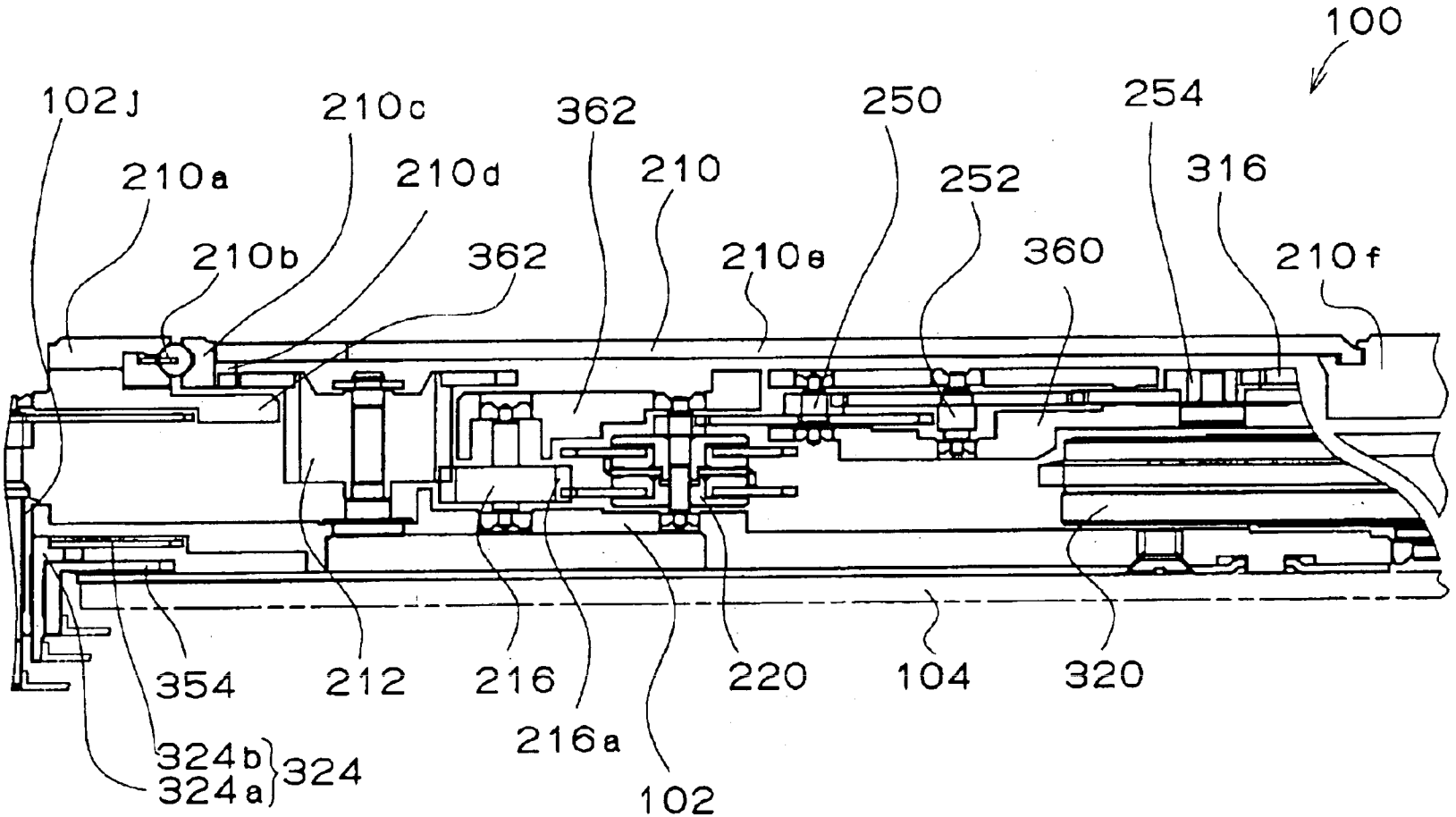
FIG. 2 is an outline partially sectional view showing the self-winding mechanism including the oscillating weight, the first intermediate wheel, a second intermediate wheel and the switching transmission wheel according to the embodiment of the self-winding timepiece of the invention.

Embodiments of a self-winding timepiece according to the invention will be explained in reference to the drawings as follows.

(1) Structure of Top Side of Movement

First, an explanation will be given of structures of a top train wheel, an escaping mechanism and a speed control mechanism arranged on a top side of a "movement" (side of main plate opposed to dial) in an embodiment of a self-winding timepiece according to the invention. "Movement" signifies a machine body of a timepiece including a mechanism of driving the timepiece.

In reference to FIG. 1 through FIG. 3, and FIG. 7 through FIG. 9, in the self-winding timepiece of the invention, a movement 100 includes a main plate 102 comprising a base plate of the movement 100. A winding stem 310 is rotatably integrated to a winding stem guide hole of the main plate 102. A dial 104 (shown in FIG. 1, FIG. 2, FIG. 8, FIG. 9 by imaginary lines) is attached to the movement 100.

Generally, in both sides of the main plate, a side thereof having the dial is referred to as "back side" of the movement (or, "back side of main plate") and a side thereof opposed to the side having the dial plate is referred to as "top side" of the movement (or, "top side of main plate"). Further, a train wheel integrated to "top side" of the movement is referred to as "top train wheel" and a train wheel integrated to "back side" of the movement is referred to as "back train wheel". In reference to FIG. 7, an escapement speed control apparatus including a balance with hairspring 340, and escape wheel & pinion 330 and a pallet fork 342 and a top train wheel including a second wheel & pinion 328, a third wheel & pinion 326, a center wheel & pinion 325 and a movement barrel complete 320 are arranged on the "top side" of a movement 100. Further, a barrel bridge 360 for rotatably supporting an upper shaft portion of the movement barrel complete 320 and an upper shaft portion of the center wheel & pinion 325, a train wheel bridge 362 for rotatably supporting an upper shaft portion of the third wheel & pinion 326, an upper shaft portion of the second wheel & pinion 328 and an upper shaft portion of the escape wheel & pinion 330 and a pallet bridge 366 for rotatably supporting an upper shaft portion of the pallet fork 342 and a balance bridge 366 for rotatably supporting an upper shaft portion of the balance with hairspring 340 are arranged on the "top side" of the movement 100.

(2) Structures and Operation of Escapement•Speed Control Apparatus and Top Train Wheel Next, structures of the escapement•speed control apparatus and the top train wheel will be explained in the embodiment of the self-winding timepiece of the invention. A position of the winding stem 310 in an axis line direction is determined by a switching apparatus including a setting lever, a yoke, a yoke spring, a yoke holder and the like. When the winding stem 310 is rotated in a state in which the winding stem 310 is disposed at a first winding stem position (0 stage) most proximate to an inner side of the movement 100 along the rotational axis line direction, a winding pinion (not illustrated) is rotated via rotation of a clutch wheel (not illustrated). A crown wheel (not illustrated) is comprised to rotate by rotation of the winding pinion. A ratchet wheel 316 is rotated by rotation of the crown wheel. The movement barrel complete 320 is provided with a barrel wheel 320*d*, a barrel shaft 320*f* and a mainspring 322. The mainspring 322 contained in the movement barrel complete 320 is comprised to be wound up by rotating the ratchet wheel 316.

The center wheel & pinion 325 is comprised to rotate by rotation of the movement barrel complete 320. The center wheel & pinion 325 includes a center wheel 325*a* and a center pinion 325*b*. The barrel wheel 320*d* is comprised to be brought in mesh with the center pinion 325*b*. The third wheel & pinion 326 is comprised to rotate by rotation of the center wheel & pinion 325. The third wheel & pinion 326 includes a third wheel 326*a* and the third pinion 326*b*. The second wheel & pinion 328 is comprised to rotate by one rotation in 1 minute by rotation of the third wheel & pinion 326. The second wheel & pinion 328 includes a second wheel 328*a* and a second pinion 328*b*. The third wheel 326*a* is comprised to be brought in mesh with the second pinion 328*b*. The escape wheel & pinion 330 is comprised to rotate by rotation of the second wheel & pinion 328 while being controlled by the pallet fork 342. The escape wheel & pinion 330 includes an escape wheel 330*a* and an escape pinion 330*b*. The second wheel 328*a* is comprised to be brought in mesh with the escape pinion 330*b*. The movement barrel complete 320, the center wheel & pinion 325, the third wheel & pinion 326 and the second wheel & pinion 328 comprise the top train wheel.

The escapement•speed control apparatus for controlling rotation of the top train wheel includes the balance with hairspring 340, the escape wheel & pinion 330 and the pallet fork 342. The balance with hairspring 340 includes a balance shaft 340*a*, a balance wheel 340*b* and a hairspring 340*c*. The hairspring 340*c* is a thin plate spring of a mode in a spiral shape (helical shape) having a plural winding number. The balance with hairspring 340 is rotatably supported by the main plate 102 and the balance bridge 366.

A minute indicator 324 includes a minute wheel 324*a* and a cannon pinion 324*b*. The minute wheel 324*a* is comprised to be brought in mesh with the third pinion 326*b*. The minute wheel 324*a* and the cannon pinion 324*b* are comprised to rotate integrally. The cannon pinion 324*b* and the minute wheel 324*a* are provided with a slip mechanism comprised such that the cannon pinion 324*b* can be slipped relative to the minute wheel 324*a*. A minute wheel & pinion 348 is comprised to rotate by rotation of the third wheel & pinion 326 via rotation of the minute indicator 324. The minute wheel & pinion 348 includes a minute wheel 348*a* and a minute pinion 348*b*. The cannon pinion 324*b* is comprised to be brought in mesh with the minute wheel 348*a*. An hour wheel 354 is comprised to be brought in mesh with the minute pinion 348*b*. The hour wheel 354 is comprised to rotate by one rotation in 12 hours by rotation of the minute wheel & pinion 348. The minute indicator 324, the minute wheel & pinion 348 and the hour wheel 354 comprise the back train wheel.

The movement barrel complete 320 and the center wheel & pinion 325 are rotatably supported by the main plate 102 and the barrel bridge 360. That is, an upper shaft portion of the movement barrel complete 320, an upper shaft portion of the center wheel & pinion 325 and an upper shaft portion of the escape wheel & pinion 330 are rotatably supported by the train wheel bridge 362. Further, a lower shaft portion of the movement barrel complete 320 and a lower shaft portion of the center wheel & pinion 325 are rotatably supported by the main plate 102. The third wheel & pinion 326, the second wheel & pinion 328 and the escape wheel & pinion 330 are rotatably supported by the main plate 102 and the train wheel bridge 362. That is, an upper shaft portion of the third wheel & pinion 326, an upper shaft portion of the second wheel & pinion 328 and an upper shaft portion of the escape wheel & pinion 330 are rotatably supported by the train wheel bridge 362.

Further a lower shaft portion of the third wheel & pinion 326 and a lower shaft portion of the escape wheel & pinion 330 are rotatably supported by the main plate 102. A lower shaft portion of the second wheel & pinion 328 is rotatably supported in a center hole of a center pipe 102*j* fixed to the main plate 102. The pallet fork 342 is rotatably supported by the main plate 102 and a pallet bridge 364. That is, an upper shaft portion of the pallet fork 342 is supported rotatably by the pallet bridge 364. A lower shaft portion of the pallet fork 342 is rotatably supported by the main plate 102.

The minute indicator 324 is rotated by one rotation in 1 hour by rotation of the movement barrel complete 320 via rotation of the center wheel & pinion 325 and the third wheel & pinion 326. A minute hand 352 attached to the cannon pinion 324*b* of the minute indicator & pinion 324 indicates "minute". The second wheel & pinion 328 is rotated by one rotation in 1 minute by rotation of the center wheel & pinion 325 via rotation of the third wheel & pinion 326. A second hand 358 attached to the second wheel & pinion 328 indicates "second". The hour wheel 354 is rotated by one rotation for 12 hours based on rotation of the minute indicator 324 via rotation of the minute wheel 348. An hour hand 356 attached to the hour wheel 354 indicates "hour".

Figure 13:
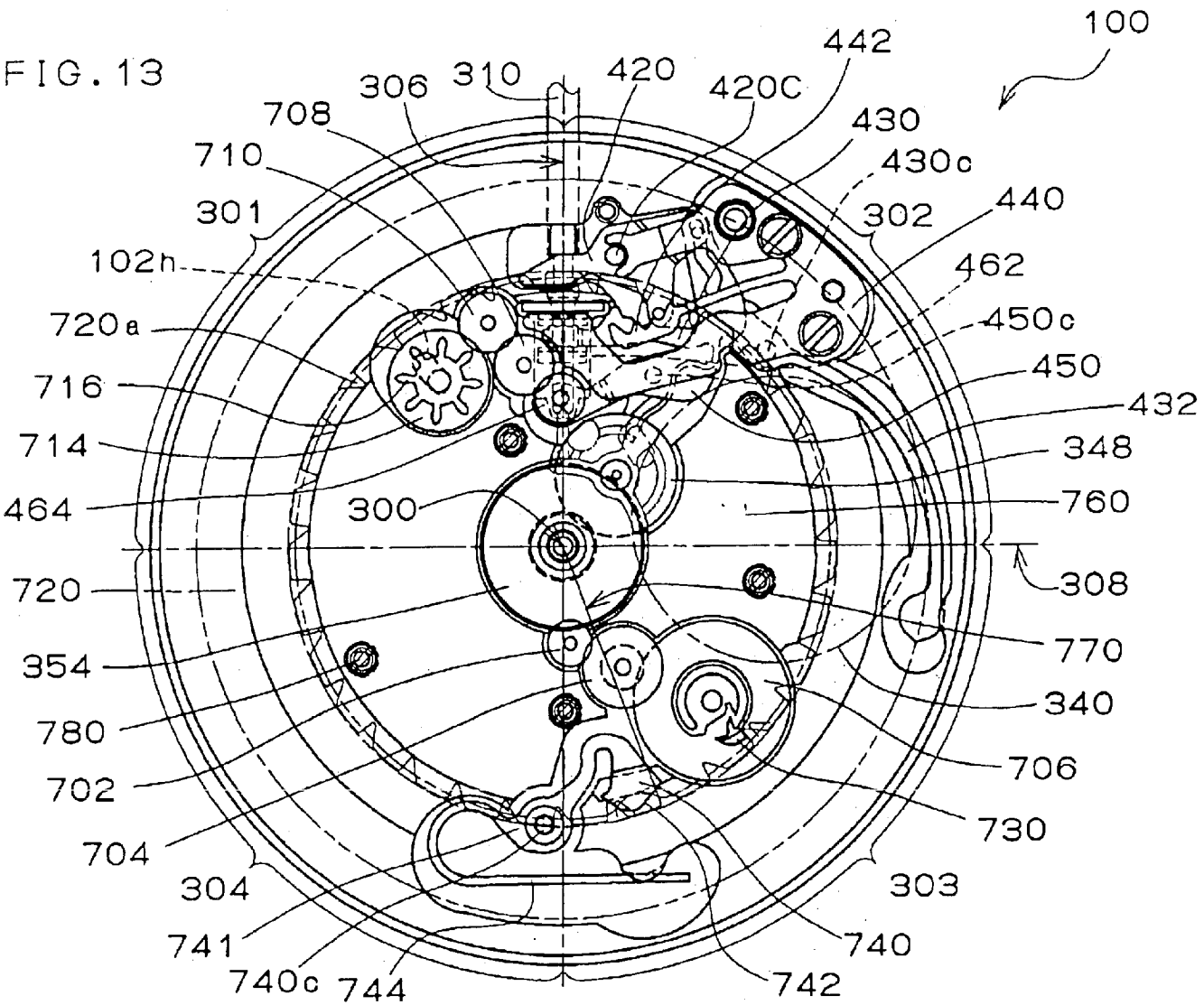
FIG. 13 is a plane view showing an outline shape of a back side of the movement in a state in which the winding stem is disposed at 0 stage to start feeding a date indicator according to the embodiment of the self-winding timepiece of the invention.

When the winding stem 310 is rotated in a state in which the winding stem 310 is pulled to dispose at a third winding stem position (second stage), the minute wheel 348 can be rotated via rotation of a clutch wheel 462 (refer to FIG. 13) and a setting wheel 464 (refer to FIG. 13). When the minute wheel 348 is rotated under the state, the cannon pinion 324*b* and the hour wheel 354 can be rotated and therefore, time of the timepiece can be corrected. Under the state, the cannon pinion 324*b* can be slipped relative to the minute wheel 324*a* by the slip mechanism provided to the cannon pinion 324*b* and the minute wheel 324*a*.

(3) Structure of Self-winding Mechanism

Next, a structure of self-winding mechanism will be explained in the embodiment of the self-winding timepiece of the invention. In reference to FIG. 1 through FIG. 3, the self-winding mechanism includes an oscillating weight 210, a first intermediate wheel & pinion 212 rotated based on rotation of the oscillating weight 210, a second intermediate wheel 216 rotated based on rotation of the first intermediate wheel & pinion 212, a switching transmission wheel 220 rotated in one direction based on rotation of the first intermediate wheel & pinion 212 and the second intermediate wheel 216, a first reduction wheel & pinion 250 rotated based on rotation of the switching transmission wheel 220, a second reduction wheel 252 rotated based on the first reduction wheel & pinion 250, and a third reduction wheel & pinion 254 rotated based on rotation of the second reduction wheel 252. The oscillating wheel 250 includes an inner ring 210*a* fixed to the train wheel bridge 362, a plurality of balls 210*b*, an outer ring 210*c*, an oscillating weight pinion 210*d* integrally provided with the outer ring 210*c*, an oscillating weight body 210*e* fixed to the outer ring 210*c*, and an oscillating heavy weight 210*f* fixed to the oscillating weight body 210*e*. The outer ring 210*c* is comprised to be rotatable relative to the inner ring 210*a* via the ball 210*b*.

The first intermediate wheel & pinion 212 includes a first intermediate wheel 212*a* and a first intermediate pinion 212*b*. The first intermediate wheel & pinion 212 is provided rotatably relative to a first intermediate wheel pin 102*g* provided at the main plate 102. The oscillation weight pinion 210*d* is comprised to be brought in mesh with the first intermediate wheel 212*a*. The second intermediate wheel 216 includes a second intermediate wheel gear 216*a*. The second intermediate wheel gear 216*a* is comprised to be brought in mesh with the first intermediate pinion 212*b*. An upper shaft portion of the second intermediate wheel 216 and an upper shaft portion 220*a* of the switching transmission wheel 220 are provided rotatably by the wheel train bridge 362. A lower shaft portion of the second intermediate wheel 216 and a lower shaft portion 220*e* of the switching transmission wheel 220 are provided rotatably by the main plate 102.

The first reduction wheel & gear 250 includes a first reduction wheel 250*a* and a first reduction pinion 250*b*. The second reduction wheel 252 includes a second reduction wheel gear 252*a*. The first reduction pinion 250*b* is comprised to be brought in mesh with the second reduction wheel gear 252*a*. The third reduction wheel 254 includes a third reduction wheel 250*a* and a third reduction pinion 254*b*. The second reduction wheel gear 252*a* is comprised to be brought in mesh with the first reduction pinion 250*b* and the third reduction wheel 254*a*. An upper shaft portion of the first reduction wheel & pinion 250 and an upper shaft portion of the second reduction wheel 252 are provided rotatably by a reduction bridge 270. A lower shaft portion of the first reduction wheel & pinion 250 and a lower shaft portion of the second reduction wheel 252 are provided rotatably by the barrel bridge 360. The third reduction wheel & pinion 254 is provided rotatably by a third reduction wheel pin 360*g* provided at the barrel bridge 360. The third reduction pinion 254*b* is comprised to be brought in mesh with the ratchet wheel 316.

(4) Structure of Switching Transmission Wheel

Next, a structure of switching transmission wheel will be explained in the embodiment of self-winding timepiece of the invention. In reference to FIG. 1 through FIG. 4, the switching transmission wheel 220 includes a switching transmission pinion 222, a switching upper stage wheel 230 provided rotatably relative to the switching transmission pinion 222, a switching upper spacer 236 fixed to the switching transmission pinion 222, a switching finger 238 fixed to the switching transmission pinion 222, a switching lower stage wheel 240 provided rotatably relative to the switching transmission pinion 222, and a switching lower spacer 246 fixed to the switching transmission pinion 222. The switching transmission pinion 222 includes an upper shaft portion 222*a*, a pinion portion 222*b*, a first stage portion 222*c*, a second stage portion 222*d*, and a lower shaft portion 222*e*. The switching upper spacer 236 is fixed to the first stage portion 222*c*. The switching lower spacer 246 is fixed to the second stage portion 222*d*.

The switching upper stage portion 230 includes a switching upper wheel body 232 brought in mesh with the first intermediate pinion 212*b* and a switching upper finger wheel 234 having a ratchet wheel 234*h* and fixed to the switching upper wheel body 232. The switching upper wheel body 232 and the switching upper finger wheel 234 are comprised to be rotatable relative to the switching upper spacer 236 between a flange portion of the switching upper seat 236 and the switching finger 238. The switching lower stage wheel 240 includes a switching lower wheel body 242 brought in mesh with the second intermediate wheel 216*a* of the second intermediate wheel & gear 216 and a switching lower finger wheel 244 having a ratchet wheel 244*h* and fixed to the switching lower wheel body 242. The switching lower wheel body 242 and the switching lower finger wheel 244 are comprised to be rotatable relative to the switching lower seat 246 between a flange portion of the switching lower spacer 246 and the switching finger 233.

Figure 4:
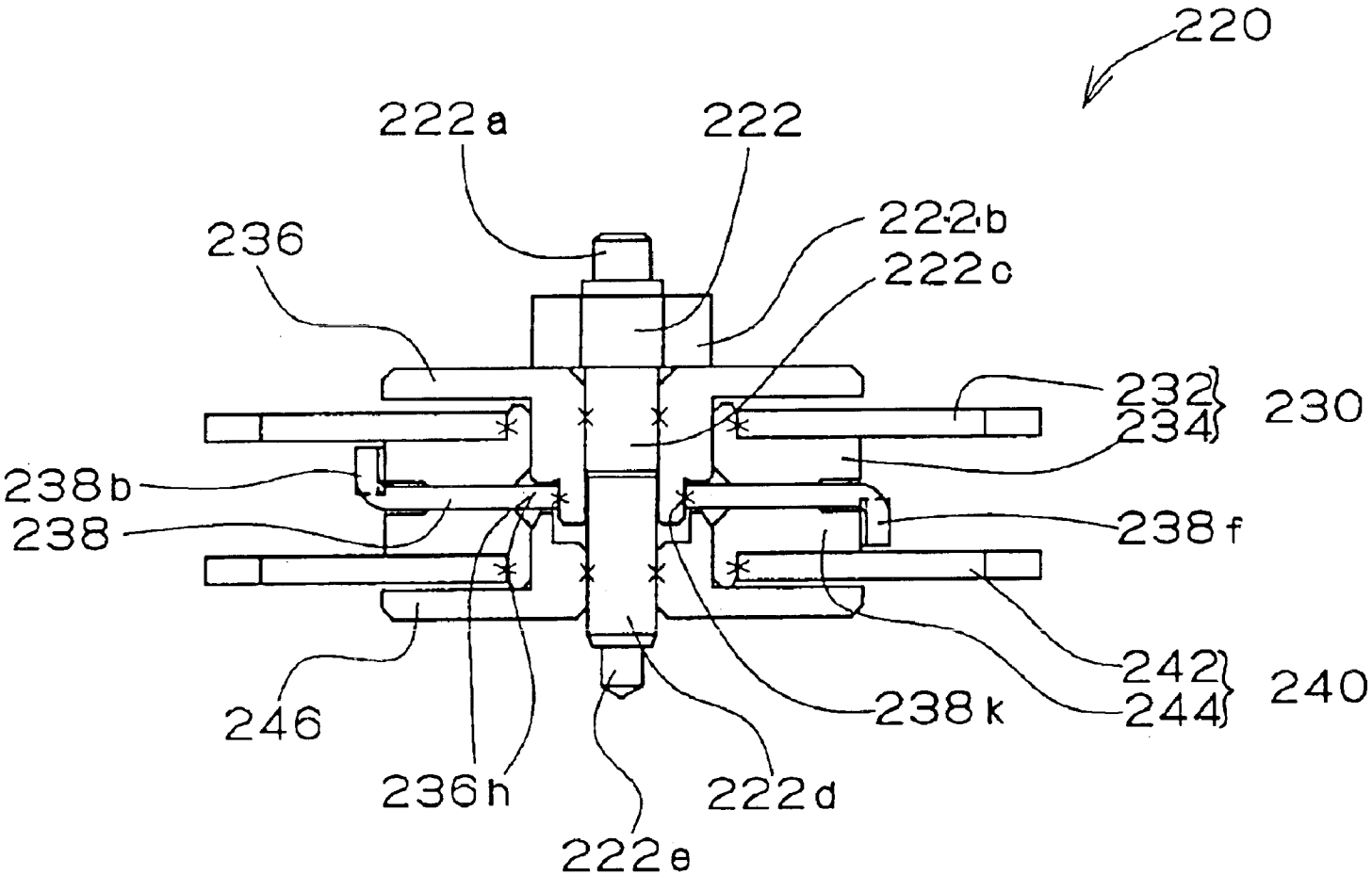
FIG. 4 is a sectional view showing a structure of the switching transmission wheel according to the embodiment of the self-winding timepiece of the invention.
Figure 5:
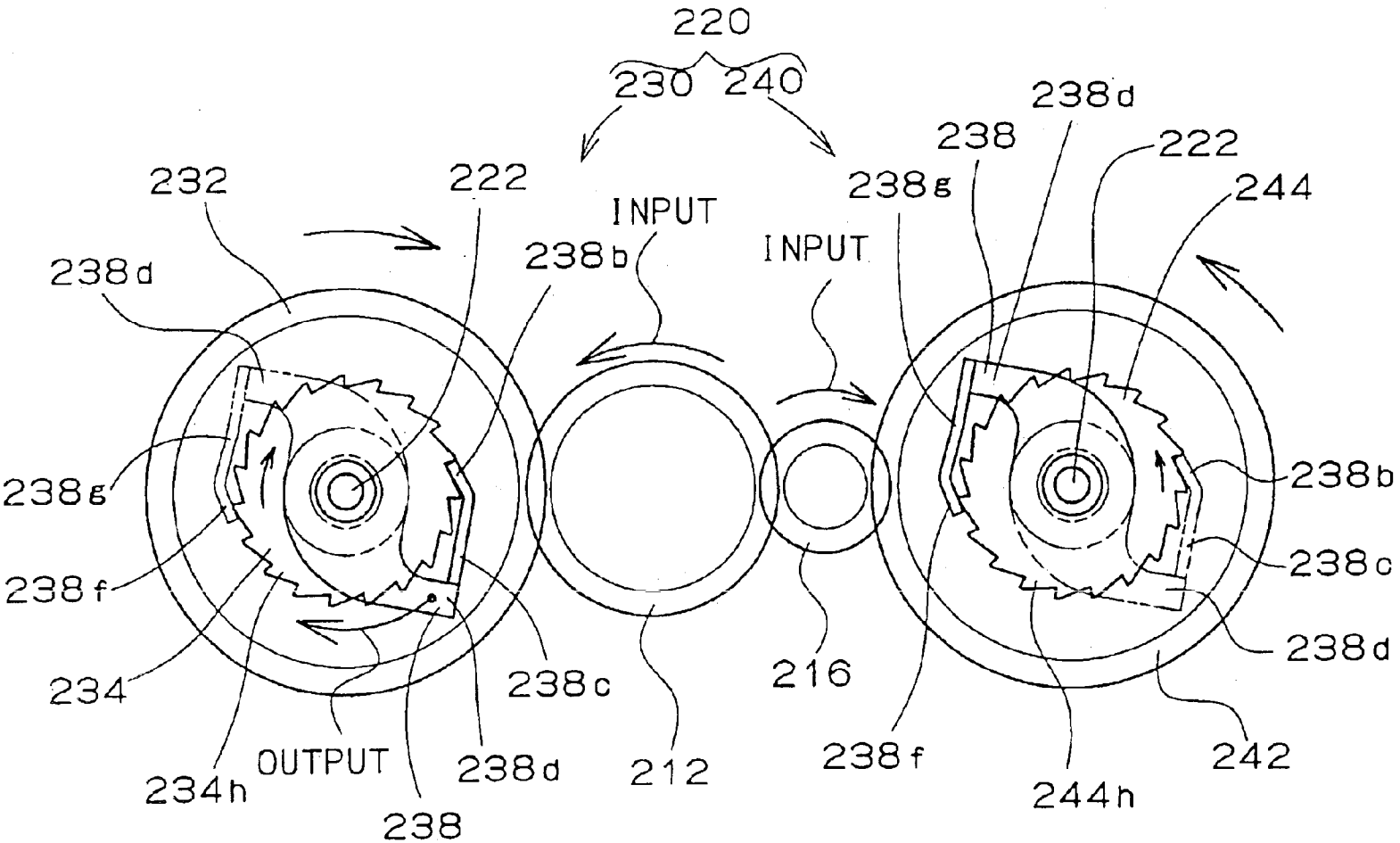
FIG. 5 is a plane view showing operation principle of the switching transmission wheel when the first intermediate wheel is rotated in the counterclockwise direction according to the embodiment of the self-winding timepiece of the invention.
Figure 6:
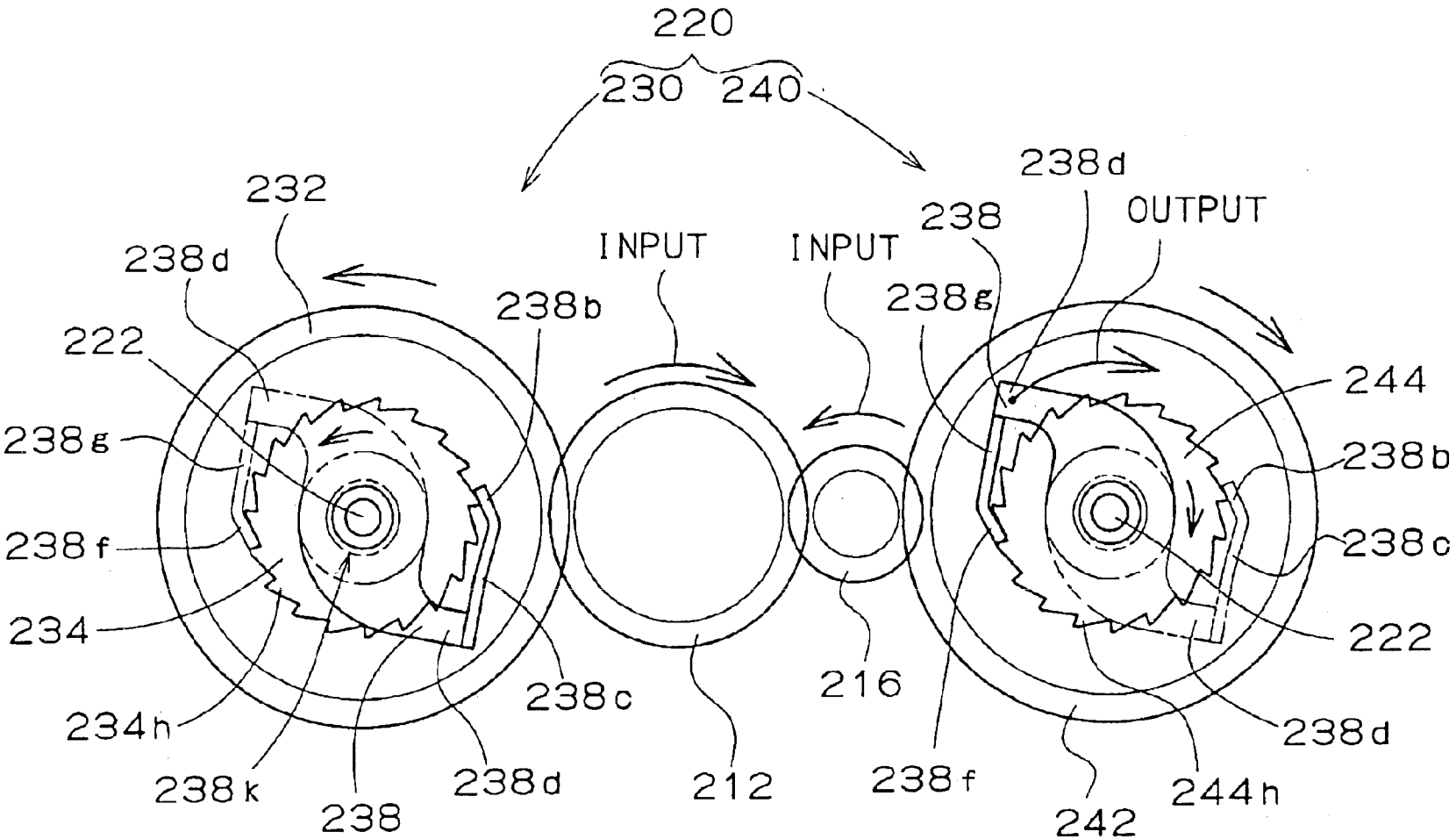
FIG. 6 is a plane view showing the operation principle of the switching transmission wheel when the first intermediate wheel is rotated in the clockwise direction according to the embodiment of the self-winding timepiece of the invention.

In reference to FIG. 4 through FIG. 6, the switching finger 238 includes an upper operating portion 238*b*, an upper spring portion 238*c*, a base portion 238*d*, a lower operating portion 238*f*, a lower spring portion 238*g*, and a center hole 238*k* provided at the base portion 238*d*. The upper spring portion 238*c* of the switching finger 238 is provided between the upper operating portion 238*b* and the base portion 238*d* and the lower spring portion 238*g* of the switching finger 238 is provided between the lower operating portion 238*f* and the base portion 238*d*.

The switching finger 238 is made of an elastic material of stainless steel or the like. The center hole of the base portion 238*d* is fixed to the switching upper spacer 238. Therefore, the switching finger 238 is comprised to rotate integrally with the switching reduction pinion 222. The upper operating portion 238*b* of the switching finger 238 is comprised to be able to be brought in mesh with the ratchet wheel 234*h* of the switching upper finger wheel 234. The lower operating portion 238*f* of the switching finger 238 is comprised to be able to be brought in mesh with the ratchet wheel 244*h* of the switching lower finger wheel 244. The upper spring portion 238*c* of the switching finger 238 may preferably be comprised to be orthogonal in an upper direction relative to the base portion 238*d*. The upper operating portion 238*b* of the switching finger 238 is formed at a front end portion of the upper spring portion 238*c*. By the constitution, the upper operating portion 238*b* of the switching finger 238 is firmly pressed to the ratchet wheel 234*h* of the switching upper finger wheel 234 by elastic force of the upper spring portion 238*c*.

The lower spring portion 238*g* of the switching finger 238 may preferably be comprised to be orthogonal in a lower direction relative to the base portion 238*d*. The lower operating portion 238*f* of the switching finger 238 is formed at a front end portion of the lower spring portion 238*g*. By the constitution, the lower operating portion 238*f* of the switching finger 238 is firmly pressed to the ratchet wheel 244*h* of the switching lower finger wheel 244 by elastic force of the lower spring portion 238*g*. A planar shape of the switching finger 238 when projected to a plane in parallel with the base portion 238*d* may preferably be a shape of point symmetry with the center hole 238*k* of the switching finger 238 as a reference. By the constitution, the switching finger 238 is pressed to the ratchet wheel 234*h* of the switching upper finger wheel 234 and the ratchet wheel 234*h* of the switching lower finger wheel 244 firmly with excellent balance.

(5) Operation of Self-winding Mechanism

Next, operation of a self-winding mechanism will be explained in the embodiment of the self-winding timepiece of the invention. An explanation will be given of operation when the oscillating weight 210 is rotated in the clockwise direction in reference to FIG. 3 and FIG. 5. When the oscillating weight 210 is rotated in the clockwise direction, the first intermediate wheel 212 is rotated in the counterclockwise direction. When the first intermediate wheel 212 is rotated in the counterclockwise direction, the switching upper wheel body 232 is rotated in the clockwise direction. When the switching upper wheel body 232 is rotated in the clockwise direction, also the switching upper finger wheel 234 is rotated in the clockwise direction. Under the state, the upper operating portion 238*b* of the switching finger 238 is brought in mesh with, the ratchet wheel 234*h* of the switching upper finger wheel 234. Therefore, by rotating the switching upper finger wheel 234 in the clockwise direction, also the switching finger 238 is rotated in the clockwise direction and therefore, also the switching transmission pinion 222 is rotated in the clockwise direction.

Further, when the first intermediate wheel 212 is rotated in the counterclockwise direction, the second intermediate wheel 216 is rotated in the clockwise direction. When the second intermediate wheel 216 is rotated in the clockwise direction, the switching lower wheel body 242 is rotated in the counterclockwise direction. When the switching lower wheel body 242 is rotated in the counterclockwise direction, also the switching lower finger wheel 244 is rotated in the counterclockwise direction. Under the state, the lower operating portion 238*f* of the switching finger 238 is operated to escape from the ratchet wheel 244*h* of the switching lower finger wheel 244. Therefore, the switching reduction pinion 222 cannot be rotated by rotating the switching lower wheel body 242.

Figure 3:
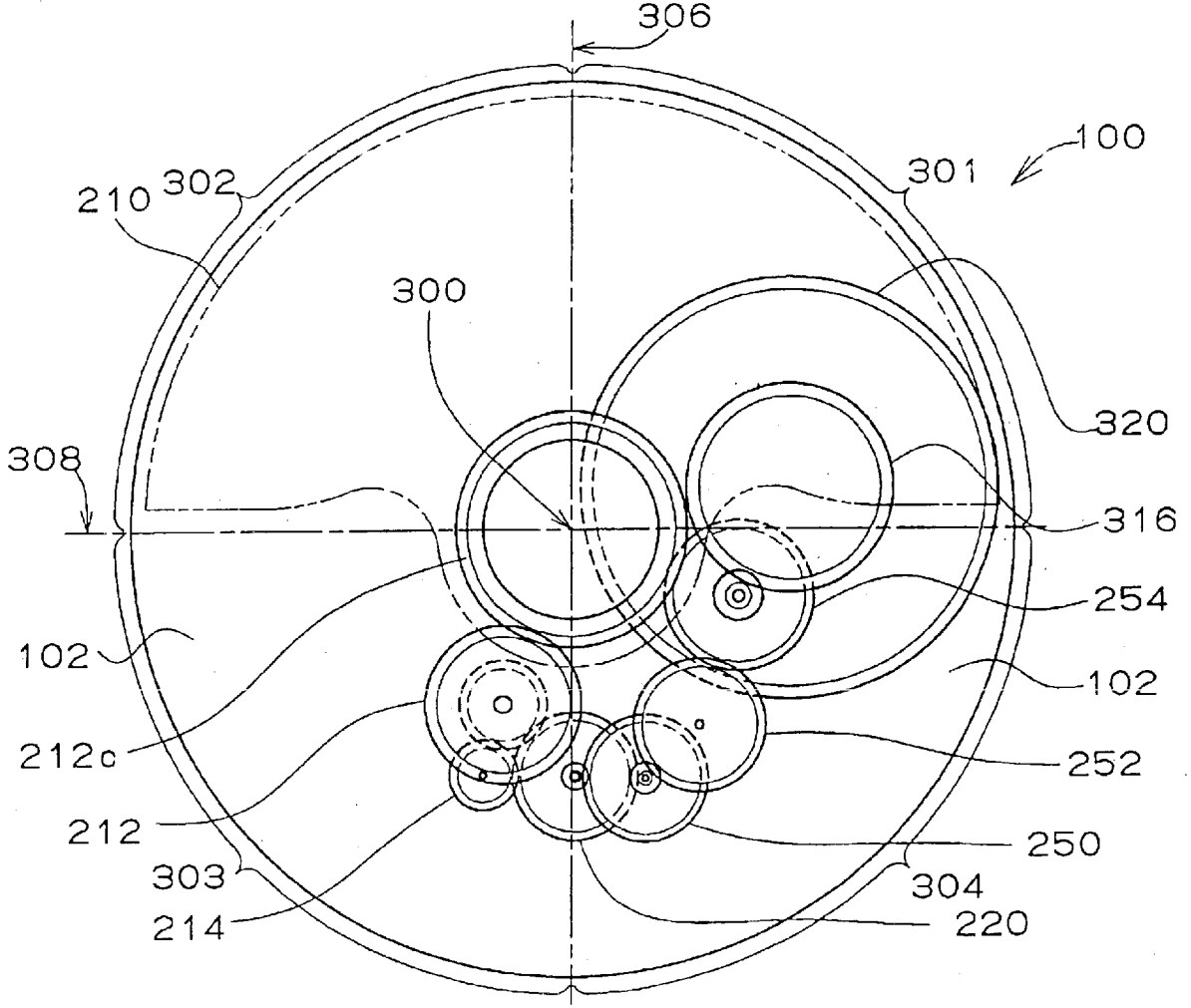
FIG. 3 is a plane view showing an outline constitution of the self-winding mechanism according to the embodiment of the self-winding timepiece of the invention.

Next, an explanation will be given of an operation when the oscillating weight 210 is rotated in the counterclockwise direction in reference to FIG. 3 and FIG. 6. When the oscillating weight 210 is rotated in the counterclockwise direction, the first intermediate wheel 212 is rotated in the clockwise direction. When the first intermediate wheel 212 is rotated in the clockwise direction, the switching upper wheel body 232 is rotated in the counterclockwise direction. When the switching upper wheel body 232 is rotated in the counterclockwise direction, also the switching upper finger wheel 234 is rotated in the counterclockwise direction. Under the state, the upper operating portion 238*b* of the switching finger 238 is operated to escape from the ratchet wheel 234*h* of the switching upper finger wheel 234. Therefore, the switching transmission pinion 222 cannot be rotated by rotating the switching upper wheel body 232.

Further, when the first intermediate wheel 212 is rotated in the clockwise direction, the second intermediate wheel 216 is rotated in the counterclockwise direction. When the second intermediate wheel 216 is rotated in the counterclockwise direction, the switching lower wheel body 242 is rotated in the clockwise direction. When the switching lower wheel body 242 is rotated in the clockwise direction, also the switching lower finger wheel 244 is rotated in the clockwise direction. Under the state, the lower operating portion 238*f* of the switching finger 238 is brought in mesh with the ratchet wheel 244*h* of the switching lower finger wheel 244. Therefore, by rotating the switching lower finger wheel 244 in the clockwise direction, also the switching finger 238 is rotated in the clockwise direction and therefore, the switching transmission pinion 222 is also rotated in the clockwise direction.

As has been explained above, according to the self-winding mechanism of the self-winding timepiece of the invention, the switching transmission pinion 222 can be rotated in a constant direction, that is, in the clockwise direction when the oscillating weight 210 is rotated in the clockwise direction and when the rotating weight 210 is rotated in the counterclockwise direction. Such an operation is firmly carried out by the switching transmission wheel 220 of the self-winding timepiece according to the invention having the switching finger 238.

According to the self-winding mechanism of the self-winding timepiece of the invention, regardless of the direction of oscillating the oscillating weight 210, the rotating direction of the switching transmission pinion 222 is constant and therefore, based on rotation of the switching transmission pinion 222, the ratchet wheel 316 can be rotated only in one direction via the first reduction wheel & pinion 250 and the third reduction wheel & pinion 252. In reference to FIG. 3 and FIG. 8, by rotating the ratchet wheel 316, the mainspring 322 in the movement barrel complete 320 can be wound up only in one direction.

(5) Structure of Operation of Modified Example of Self-winding Mechanism

Next, an explanation will mainly be given of a structure and operation of a modified example of a self-winding mechanism in the embodiment of the self-winding timepiece of the invention. The following explanation is carried out only with regard to a difference between the structure and the operation of the modified example of the self-winding timepiece according to the invention and the structure and the operation of the above-described embodiment of the self-winding timepiece of the invention. Therefore, the explanation of the above-described embodiment of the self-winding timepiece of the invention will be applied to portions which are not described below.

Figure 10:
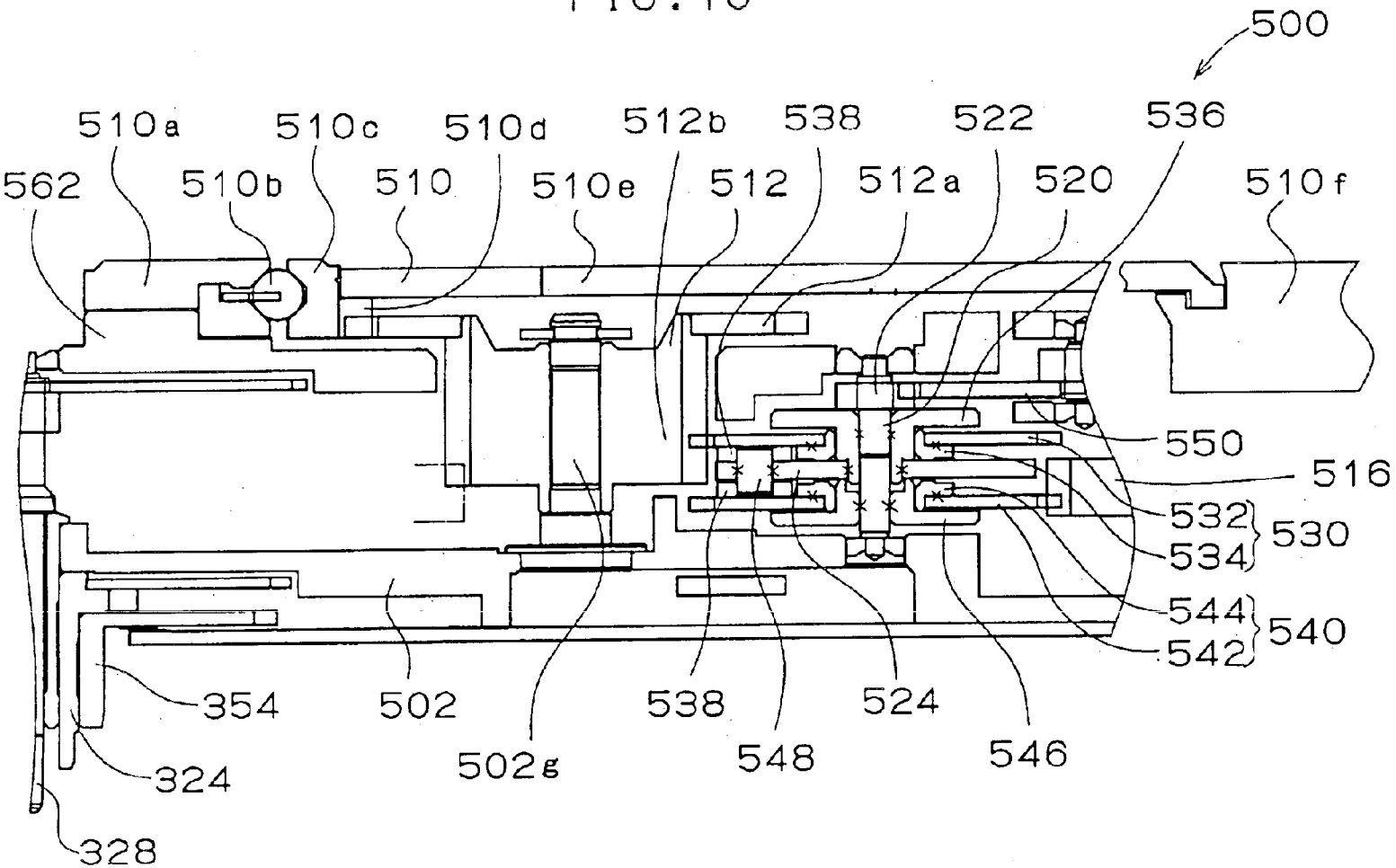
FIG. 10 is a plane view showing an outline constitution of a modified example of a self-winding mechanism according to the embodiment of the self-winding timepiece of the invention.

In reference to FIG. 10, according to the modified example of the self-winding mechanism of the self-winding timepiece of the invention, the self-winding mechanism includes an oscillating weight 510, a first intermediate wheel 212 rotated based on rotation of the oscillating weight 510, a second intermediate wheel 516 rotated based on rotation of the first intermediate wheel & pinion 512, and a switching transmission wheel 520 rotated in one direction based on rotation of the first intermediate wheel 512 and the second intermediate wheel 516. The oscillating weight 510 includes an inner ring 510*a* fixed to a train wheel bridge 562, a plurality of balls 510*b*, an outer ring 510*c*, an oscillating weight pinion 510*d* provided integrally with the outer ring 510*c*, an oscillating weight body 510*e* fixed to the outer ring 510*c*, and an oscillating heavy weight 510*f* fixed to the oscillating weight body 510*e*.

The outer ring 510*c* is comprised to be rotatable relative to the inner ring 510*a* via the ball 510*b*. The first intermediate wheel & pinion 512 includes a first intermediate wheel 512*a* and a first intermediate pinion 512*b*. The first intermediate wheel & pinion 512 is provided rotatably relative to a first intermediate wheel pin 502*g* provided at a main plate 502. The oscillating weight pinion 510*d* is brought in mesh with the first intermediate wheel 512*a*. The switching transmission wheel 520 includes a switching transmission pinion 522, a switching upper stage wheel 530, a switching upper spacer 536 fixed to the switching transmission pinion 522, a switching middle spacer 524 fixed to the switching transmission pinion 522, a switching lower stage wheel 540, and a switching lower spacer 546 fixed to the switching transmission pinion 522.

The switching upper stage wheel 530 includes a switching upper wheel body 532 brought in mesh with the first intermediate pinion 512*b*, and a switching upper finger wheel 534 having a ratchet wheel 534*h* and fixed to the switching upper wheel body 532. The switching upper wheel body 532 and the switching upper finger wheel 534 are comprised to be rotatable relative to the switching upper spacer 536 between a flange portion of the switching upper spacer 536 and the switching middle spacer 524. The switching lower stage wheel 540 includes a switching lower wheel body 542 brought in mesh with a second intermediate wheel gear of the second intermediate wheel 516 and a switching lower finger wheel 544 having a ratchet wheel 544*h* and fixed to the switching lower wheel body 542. The switching lower wheel body 542 and the switching lower finger wheel 544 are comprised to be rotatable relative to the switching lower spacer 546 between a flange portion of the switching lower spacer 546 and the switching middle spacer 524.

A switching transmission wheel pin 526 is fixed to the switching middle spacer 524. An upper clutch finger 538 is arranged between the switching upper wheel body 532 and the switching middle spacer 524 to be rotatable with the switching transmission wheel pin 526 as a rotating center. Upper ratchet fingers 538*b* and 538*c* of the upper clutch finger 538 are comprised to be able to be brought in mesh with the ratchet wheel 534*h* of the switching upper finger wheel 534. A lower clutch finger 548 is arranged between the switching lower wheel body 542 and the switching middle spacer 524 to be able to rotate with the switching transmission wheel pin 526 as the rotating center. Lower ratchet fingers 548*b* and 548*c* of the lower clutch finger 548 are comprised to be able to be brought in mesh with the ratchet wheel 544*h* of the switching lower finger wheel 544.

Figure 11:
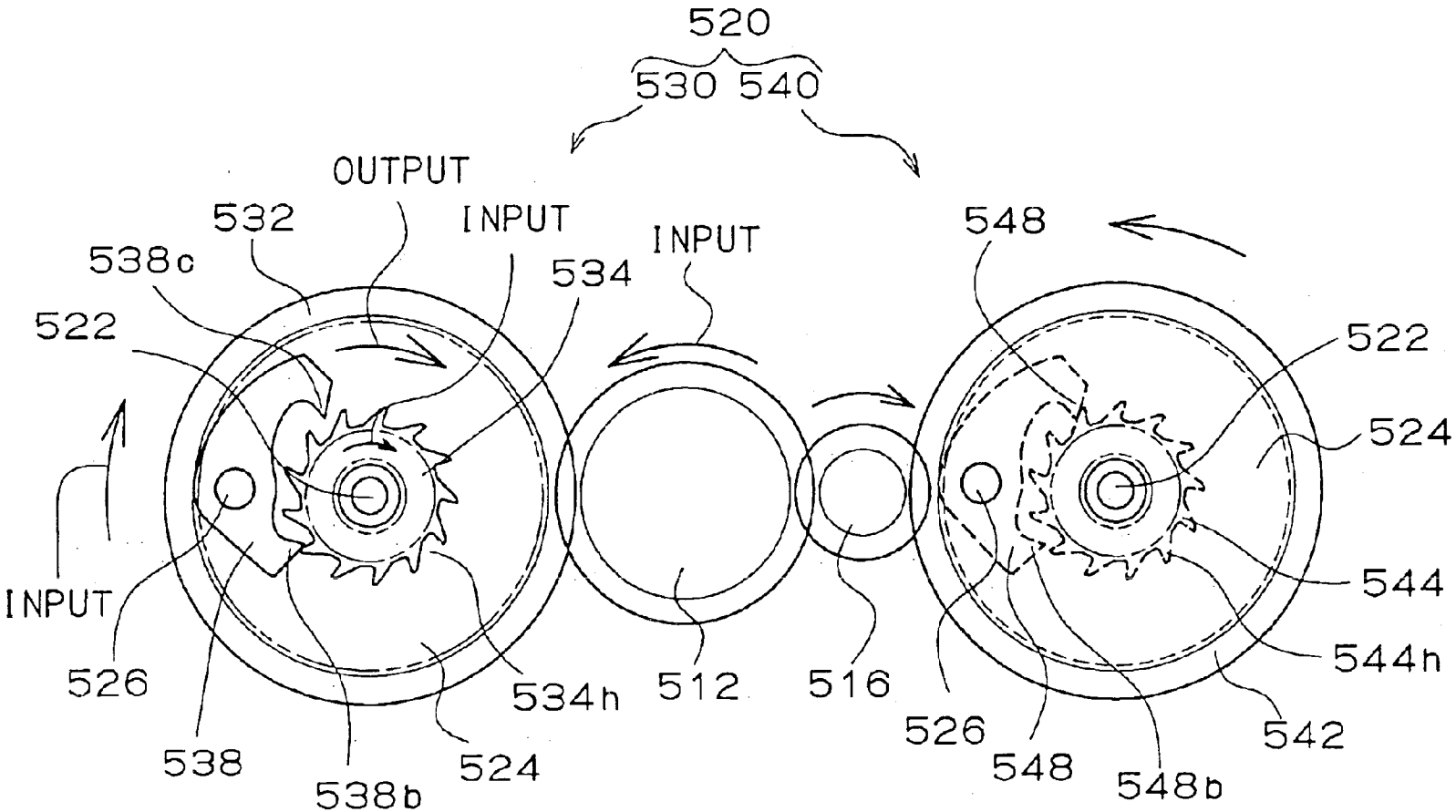
FIG. 11 is a plane view showing operation principle of a switching transmission wheel when a first intermediate wheel is rotated in the counterclockwise direction in the modified example of the self-winding mechanism according to the embodiment of the self-winding timepiece of the invention.

An explanation will be given of operation when the oscillating weight 510 is rotated in the clockwise direction in reference to FIG. 11. When the oscillating weight 510 is rotated in the clockwise direction, the first intermediate wheel 512 is rotated in the counterclockwise direction. When the first intermediate wheel 512 is rotated in the counterclockwise direction, the switching upper wheel body 532 is rotated in the clockwise direction. When the switching upper wheel body 532 is rotated in the clockwise direction, also the switching upper finger wheel 534 is rotated in the clockwise direction. Under the state, an upper ratchet finger 538*b* is brought in mesh with the ratchet wheel 534*h* of the switching upper finger wheel 534, the switching middle spacer 524 is rotated in the clockwise direction and therefore, also the switching reduction pinion 522 is rotated in the clockwise direction. Further, when the first intermediate wheel 512 is rotated in the counterclockwise direction, the second intermediate wheel 516 is rotated in the clockwise direction. When the second intermediate wheel 516 is rotated in the clockwise direction, the switching lower wheel body 542 is rotated in the counterclockwise direction. When the switching lower wheel body 542 is rotated in the counterclockwise direction, also the switching lower finger wheel 544 is rotated in the counterclockwise direction. Under the state, the lower ratchet fingers 548*b* and 548*c* are operated to escape from the ratchet wheel 544*h* of the switching lower finger wheel 544 and therefore, the switching reduction pinion 522 cannot be rotated by rotating the switching lower wheel body 542.

Figure 12:
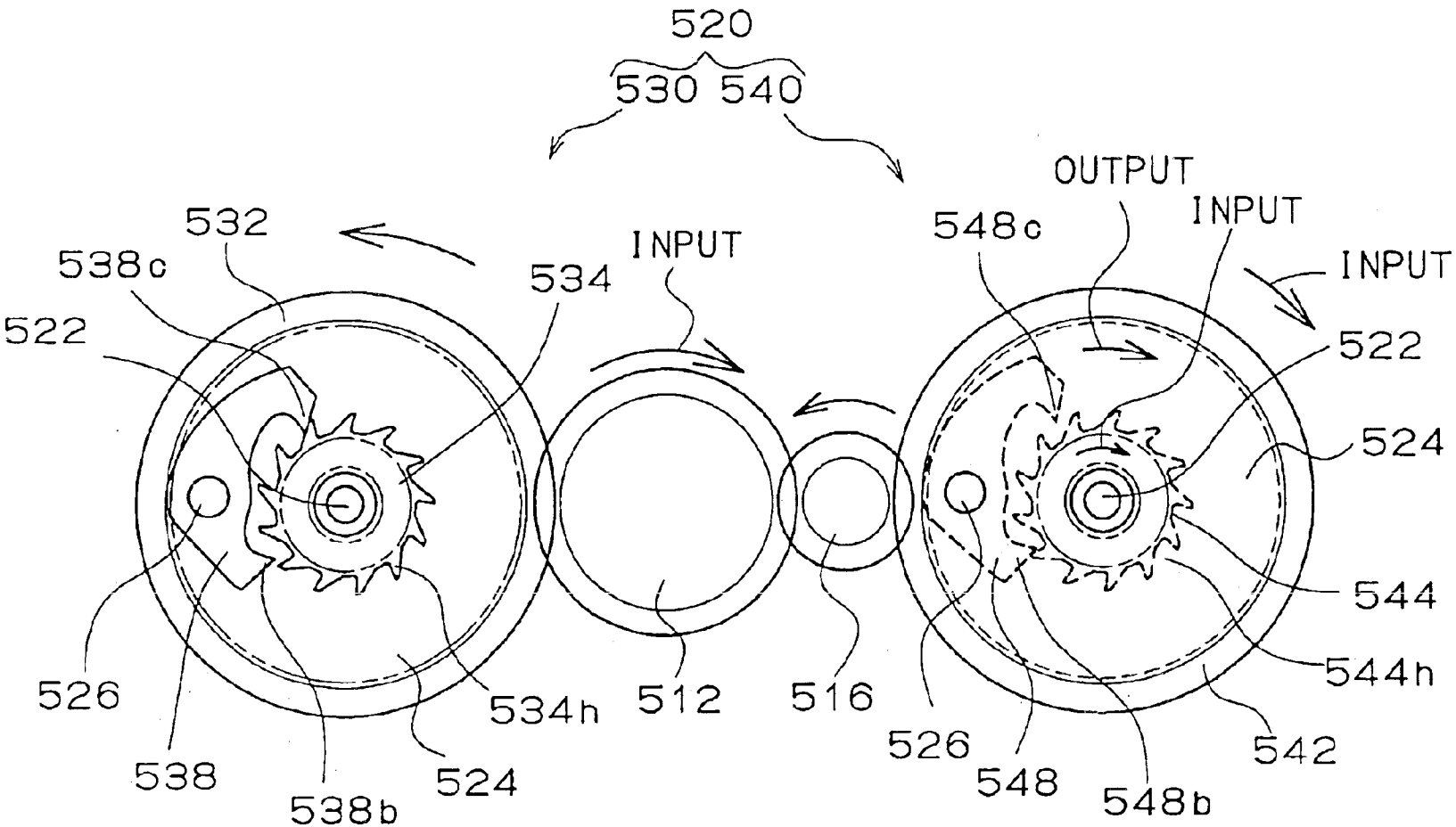
FIG. 12 is a plane view showing the operation principle of the switching transmission wheel when the first intermediate wheel is rotated in the clockwise direction in the modified example of the self-winding mechanism according to the embodiment of the self-winding timepiece of the invention.

Next, an explanation will be given of operation when the oscillating weight 510 is rotated in the counterclockwise direction in reference to FIG. 12. When the oscillating weight 510 is rotated in the counterclockwise direction, the first intermediate wheel & pinion 512 is rotated in the clockwise direction. When the first intermediate wheel & pinion 512 is rotated in the clockwise direction, the switching upper wheel body 532 is rotated in the counterclockwise direction. When the switching upper wheel body 532 is rotated in the counterclockwise direction, also the switching upper finger wheel 534 is rotated in the counterclockwise direction. Under the state, the upper ratchet fingers 538*b* and 538*c* are operated to escape from the ratchet wheel 534*h* of the switching upper finger wheel 534 and therefore, the switching transmission pinion 522 cannot be rotated by rotating the switching upper wheel body 532.

Further, when the first intermediate wheel & pinion 512 is rotated in the clockwise direction, the second intermediate wheel 516 is rotated in the counterclockwise direction. When the second intermediate wheel 516 is rotated in the counterclockwise direction, the switching lower wheel body 542 is rotated in the clockwise direction. When the switching lower wheel body 542 is rotated in the clockwise direction, also the switching lower finger wheel 544 is rotated in the clockwise direction. Under the state, the lower ratchet finger 548*b* is brought in mesh with the ratchet wheel

544*h* of the switching lower finger wheel 544, the switching middle spacer 524 is rotated in the clockwise direction and therefore, the switching reduction pinion 522 is also rotated in the clockwise direction. Therefore, according to the self-winding mechanism, the switching reduction pinion 522 can be rotated in a constant direction, that is, in the clockwise direction when the oscillating weight 510 is rotated in the clockwise direction and when the oscillating weight 510 is rotated in the counterclockwise direction.

According to the above-described modified example of the self-winding mechanism, regardless of the direction of rotating the oscillating weight 510, the rotating direction of the switching reduction pinion 522 is constant and therefore, the ratchet wheel 316 can be rotated only in one direction via rotation of a transmission train wheel including the first reduction wheel 550 and the like based on rotation of the switching transmission pinion 522. Further, the mainspring in the movement barrel complete 320 can be wound up only in one direction by rotating the ratchet wheel 316.

(6) Structure of Switching Apparatus

Figure 18:
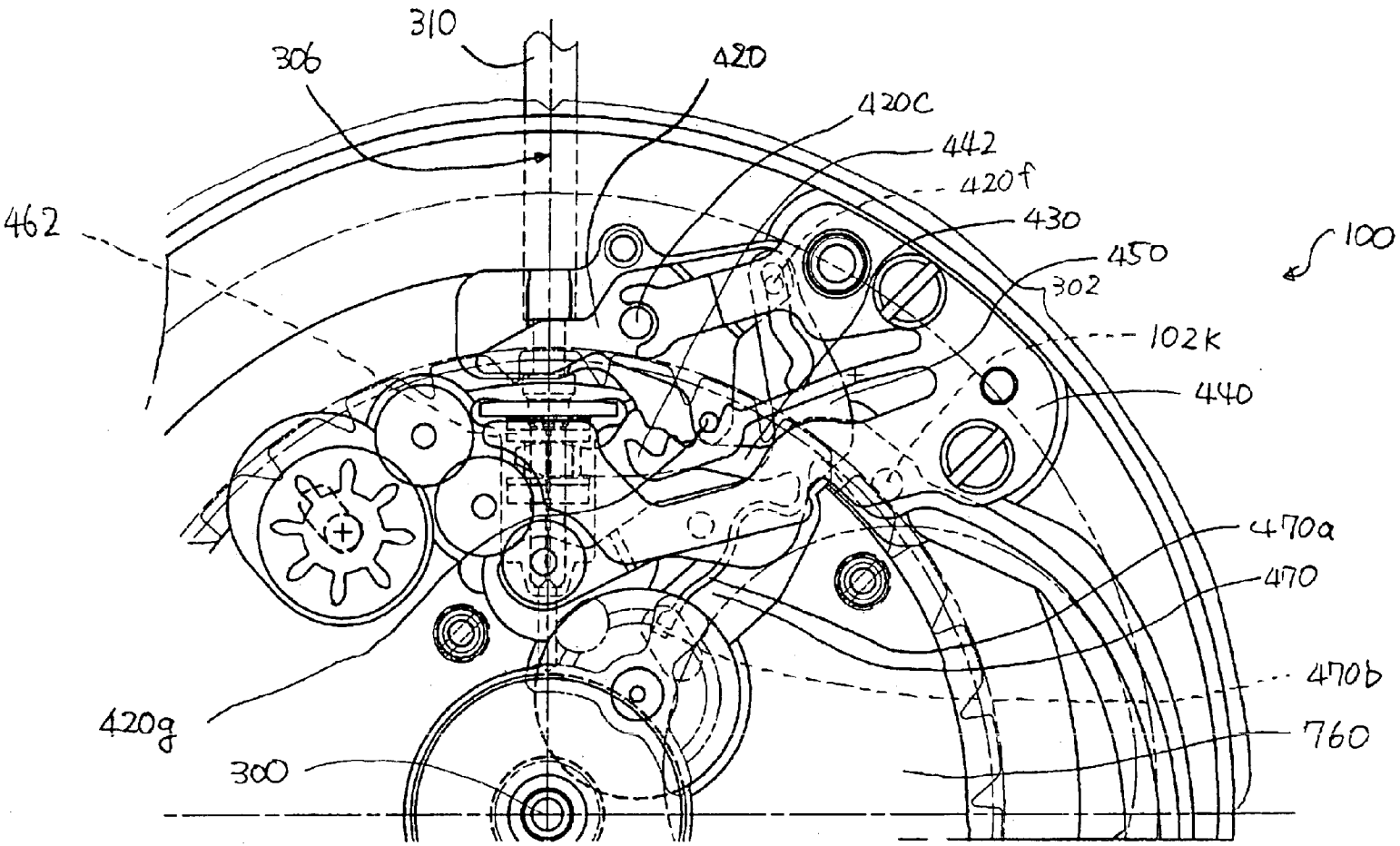
FIG. 18 is a partial plane view of the back side of the movement showing a switching mechanism and the train wheel setting mechanism in a state in which the winding stem is disposed at 0 stage according to the embodiment of the self-winding timepiece of the invention.
Figure 19:
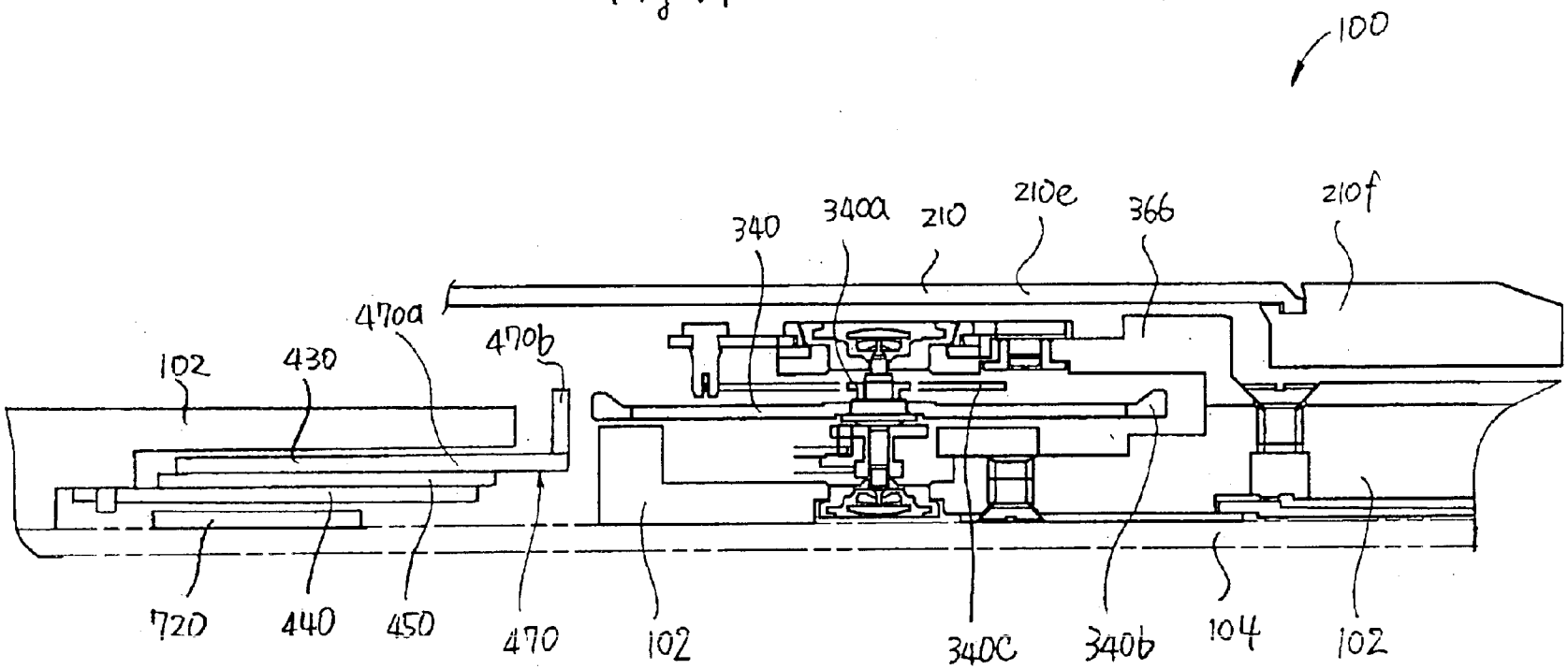
FIG. 19 is a partially sectional view showing the time wheel setting mechanism in a state in which the winding stem is disposed at 0 stage according to the embodiment of the self-winding timepiece of the invention.
Figure 20:
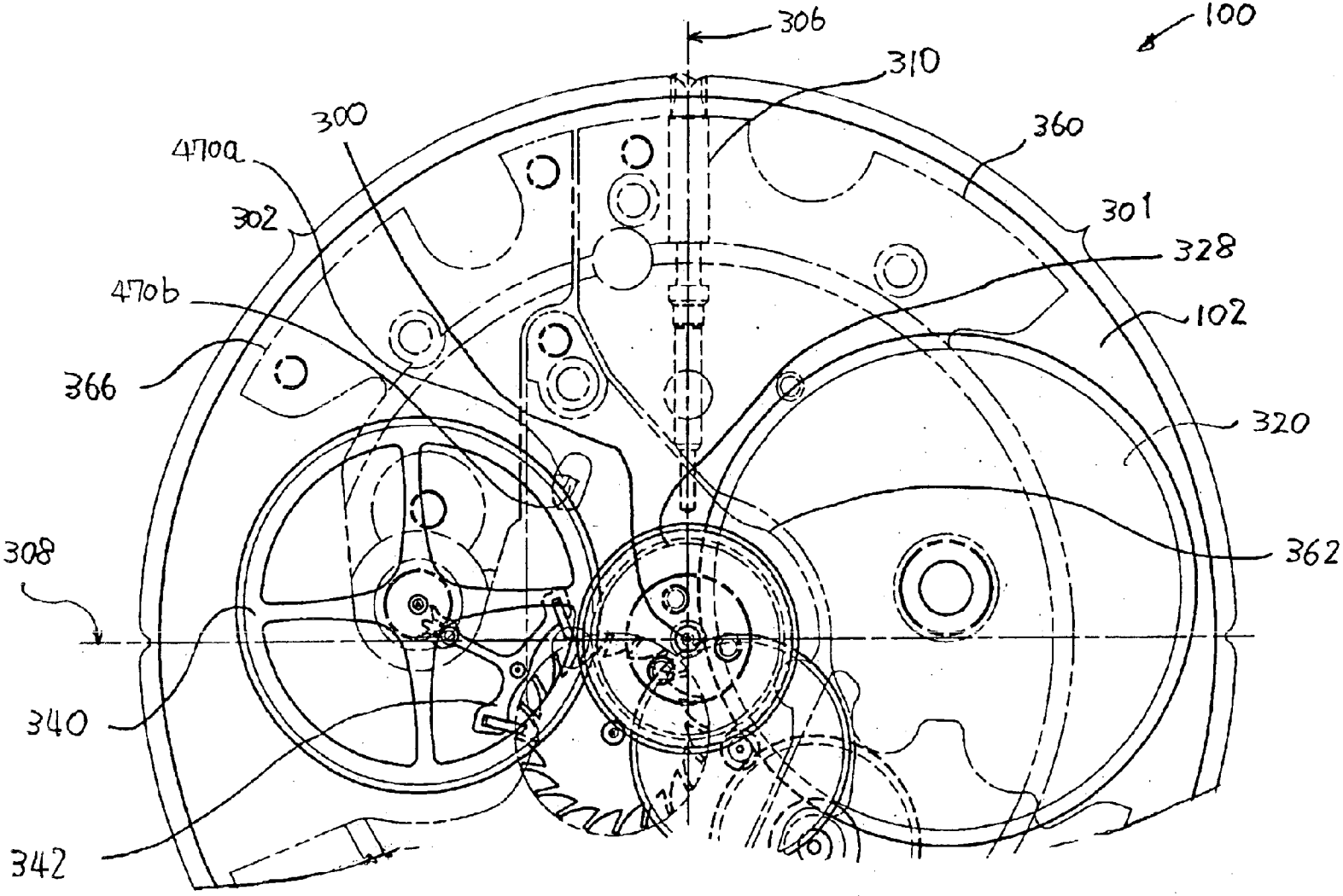
FIG. 20 is a partial plane view of the top side of the movement showing the train wheel setting mechanism in a state in which the winding stem is disposed at 2 stage according to the embodiment of the self-winding timepiece of the invention.

Next, a structure of a switching apparatus will be explained in the embodiment of the self-winding timepiece of the invention. In reference to FIG. 13 and FIG. 18, according to the self-winding timepiece of the invention, on the back side (dial side) of the movement 100, at the main plate 102 comprising the base plate of the movement, there are defined a main plate reference vertical axis line 306 passing a rotating center 300 of the minute indicator 324 (hour wheel 354) and substantially in parallel with the center axis line of the winding stem 310 and a main plate reference horizontal axis line 308 passing the rotating center 300 of the minute indicator 324 and orthogonal to the main plate reference vertical axis line 306. The main plate 102 is provided with a first region 301 disposed on one side of the main plate reference vertical axis line 306 and on a side of the main plate reference horizontal axis line 308 proximate to the winding stem 310. The main plate 102 is provided with a second region 302 disposed on other side of the main plate reference vertical axis line 306 and on a side of the main plate reference horizontal axis line 308 proximate to the winding stem 310. The main plate 102 is provided with a third region 303 disposed on the other side of the main plate reference vertical axis line 306 at which the second region 302 is present and on a side of the main plate reference horizontal axis line 308 remote from the winding stem 310. The main plate 102 is provided with a fourth region 304 disposed on the one side of the main plate reference vertical axis line 306 at which the first region is present and on the side of the main plate reference horizontal axis line 308 remote from the winding stem 310.

On the back side (dial side) of the movement 100, a pivoting center 420*c* of the setting lever 420 is disposed in the second region 302. A pivoting center 430*c* of the yoke 430 is disposed in the second region 302. A pivoting center 450*c* of the operating lever 450 is disposed in the second region 302. The yoke holder 440 presses portions of respectives of the setting lever 420, the yoke 430 and the operating lever 450 to the main plate 102. The setting lever 420, the yoke 430, the yoke holder 440 and the operating lever 450 are integrated to the back side of the main plate 102. The setting wheel 464 is rotatably attached to the operating lever 450. The clutch wheel 462 is coaxially attached to the winding stem 310.

It is preferable that the yoke holder 440 is fabricated by an elastically deformable material, for example, fabricated by stainless steel. It is preferable that the yoke 430 is fabricated by an elastically deformable material, for example, fabricated by stainless steel. A setting lever positioning pin 420*g* for positioning the setting lever 420 in the rotating direction is provided at the setting lever 420. A hat-like portion 442 of the yoke holder 440 is engaged with the setting lever positioning pin 420*g* of the setting lever 420 to position the setting lever 420 in the rotating direction and set a switching weight of the winding stem 320.

An operating lever positioning pin 420*f* for determining the position of the operating lever 450 in the rotating direction is provided at the setting lever 420. An operating lever guide hole for receiving the operating lever positioning pin 420*f* is provided at the operating lever 450. The operating lever positioning pin 420*f* is comprised to move in the operating lever guide hole by rotating the setting lever 420. Thereby, the operating lever 450 is comprised not to rotate when the winding stem 310 is set from 0 stage to 1 state and the operating lever 450 is comprised to rotate when the winding stem 310 is set from 1 stage to 2 stage.

According to the self-winding timepiece of the invention, the hat-like portion 442 of the yoke holder 440 is comprised to be able to pull the winding stem 310 from 0 stage to 1 stage or 2 stage. By spring force of a spring portion 432 of the yoke 430, a guide valley portion of the yoke 430 is pressed to a side face of a front end portion of the setting lever 420. The clutch wheel 462 is comprised not to rotate but the clutch wheel 462 is comprised to be brought in mesh with the setting wheel 464 even when the setting stem 310 is rotated in a state in which the setting stem 310 is disposed at 0 stage. The clutch wheel 462 is comprised to rotate and the clutch wheel 462 is brought in mesh with the setting wheel 464 when the winding stem 310 is rotated in a state in which the winding stem 310 is disposed at 1 stage and the setting wheel 464 is comprised to rotate via rotation of the clutch wheel 462 when the winding stem 310 is rotated. The clutch wheel 462 is comprised to rotate when the winding stem 310 is rotated in a state in which the winding stem 310 is disposed at 2 stage. Further, when the winding stem 310 is set from 1 stage to 2 stage, by rotating the operating lever 450, the clutch wheel 462 is brought in mesh with the setting wheel 464 and the setting wheel 464 is brought in mesh with the minute wheel 348. The minute wheel 348 is comprised to rotate via rotation of the clutch wheel 462 and the setting wheel 464 when the winding stem 310 is rotated under the state.

(7) Structure of Train Wheel Setting Apparatus

Next, a structure of a train wheel setting apparatus will be explained in the embodiment of the self-winding timepiece of the invention.

(7.1) Train Wheel Setting Portion Integrally Formed with Yoke

In reference to FIG. 17 through FIG. 20, a train wheel setting lever portion 470 is formed integrally with the yoke 430. The train wheel setting lever portion includes a train wheel setting lever spring portion 470*a* and a train wheel setting portion 470*b*. The train wheel setting portion 470*b* is provided at a front end of the train wheel setting lever spring portion 470*a*. The train wheel setting portion 470*b* is formed to be orthogonal to the train wheel setting lever spring portion 470*a*. The train wheel setting portion 470*b* is extended to the top side of the main plate 102 by penetrating a window portion provided at the main plate 102. The train wheel setting portion 470*b* is arranged at a position capable of setting an outer peripheral portion of a balance wheel 340*b* of the balance with hairspring 340.

The train wheel setting portion 470*b* is comprised to be able to set the outer peripheral portion of the balance wheel 340*b* by rotating the yoke 430 when the winding stem 310 is set from 1 stage to 2 stage. By providing the train wheel setting lever spring portion 470*a,* the balance wheel 340*b* can effectively be prevented from being destructed by force of setting by the train wheel setting lever portion 470.

Figure 17:
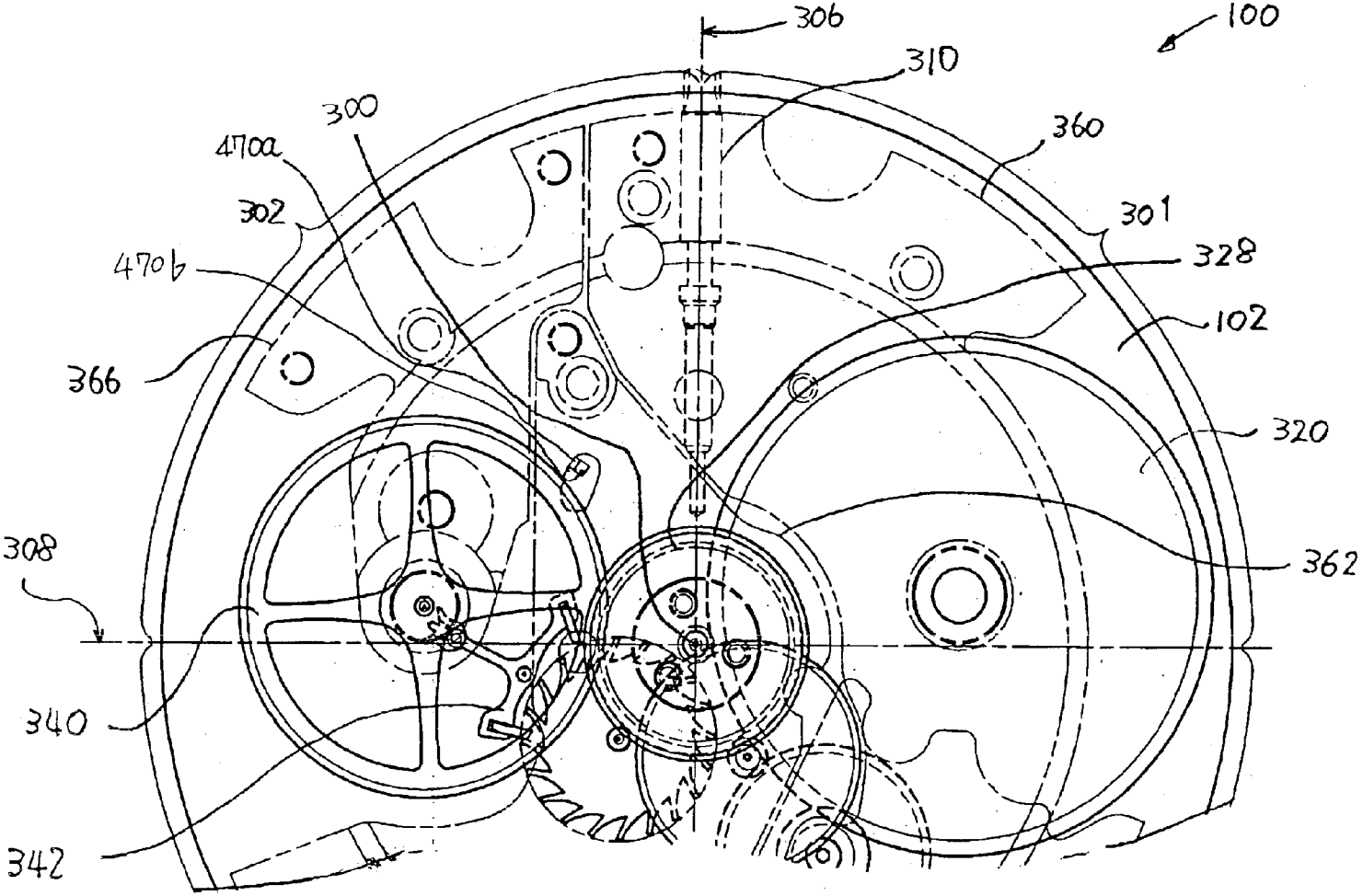
FIG. 17 is a partial plane view of the top side of the movement showing a train wheel setting mechanism in a state in which the winding stem is disposed at 0 stage according to the embodiment of the self-winding timepiece of the invention.

In reference to FIG. 17, on the top side of the movement 100, a portion of the train wheel setting portion 470*b* of the train wheel setting lever portion 470 for setting the balance wheel 340*b* is disposed in the second region 302. By the constitution, the thin and small-sized train wheel setting apparatus can efficiently be arranged at the self-winding timepiece.

(7.2) Train Wheel Setting Lever Comprised Separately from Yoke

As a modified example, on the back side of the movement 100, a train wheel setting lever (not illustrated) comprised separately from the yoke 430 can also be arranged rotatably by the main plate 102. In this case, it is preferable to fabricate the train wheel setting lever by an elastically deformable material, for example, to fabricate by stainless steel. Such a train wheel setting lever includes a train wheel setting lever spring portion, a train wheel setting portion, a base portion and a rotating spring portion. The train wheel setting lever spring portion and the rotating spring portion are extended from the base portion in directions separate from each other. The train wheel setting portion is provided at a front end of the train wheel setting lever setting portion. The train wheel setting lever is comprised to rotate with a train wheel setting lever pin provided at the main plate 102 as a rotating center. When the winding stem 310 is disposed at 0 stage, by elastic force of the rotating spring portion, the train wheel setting lever receives a force of rotating in the clockwise direction in FIG. 18. At this occasion, a position of the train wheel setting lever in the rotating direction can be comprised to position by bringing a position of the train wheel setting lever into contact with the operating lever positioning pin of the setting lever.

A portion of the train wheel setting lever is arranged between the setting lever and the operating lever. The train wheel setting portion is formed to be orthogonal to the train wheel setting lever spring portion. The train wheel setting portion is extended to the top side of the main plate 102 by penetrating a window portion provided at the main plate 102. The train wheel setting portion is arranged at a position of being capable of setting the outer peripheral portion of the balance wheel 340*b* of the balance with hairspring 340 on the top side of the main plate 102.

The train wheel setting lever is provided with a contact portion to be brought into contact with the operating lever positioning pin 420*f* provided at the setting lever 420. The operating lever positioning pin 420*f* is comprised to press the train wheel setting lever by rotating the setting lever. Thereby, the train wheel setting portion is comprised to be able to set the outer peripheral portion of the balance wheel 340*b* by rotating the train wheel setting lever by the operating lever positioning pin 420*f* when the winding stem 310 is set from 1 stage to 2 stage.

(8) Structure of Calendar Apparatus

Next, a structure of a calendar apparatus will be explained in the embodiment of the self-winding timepiece of the invention. Although in FIG. 7, the first region 301 and the fourth region 304 are disposed on the left side of the main plate reference vertical axis line 306, the regions may be defined to dispose on the right side of the main plate reference vertical axis line 306. In this case, the second region 302 and the third region 303 are defined to be disposed on the left side of the main plate reference vertical axis line 306. The hour wheel 354 is brought in mesh with an intermediate date indicator driving wheel & pinion A702. The intermediate date indicator driving wheel & pinion A702 is brought in mesh with an intermediate date indicator driving wheel of an intermediate date indicator driving wheel & pinion B704. An intermediate date indicator driving pinion of the intermediate date indicator driving wheel & pinion B704 is brought in mesh with a date indicator driving wheel 706. A date indicator 720 is rotatably integrated to the main plate 102. A date indicator driving finger 730 is integrally provided with the date indicator driving wheel 706. The date indicator driving finger 730 is comprised to rotate the date indicator 720 by rotating the date indicator driving wheel 706. The date indicator driving wheel 706 integrally formed with the date driving finger 730 comprises date indicator driving means.

A date corrector setting transmission wheel A708 is brought in mesh with a date corrector setting transmission wheel B710. The date corrector setting transmission wheel B710 is brought in mesh with a date corrector setting wheel 714. The date corrector setting wheel 714 is pivotably integrated to a circular arc long hole 102*h* of the main plate 102. A date corrector setting pinion 716 is provided integrally with the date corrector setting wheel 714. In reference to FIG. 14 and FIG. 15, the date corrector setting pinion 716 is comprised to be brought in mesh with an inner teeth portion 720*a* of the date indicator 720 when the date corrector setting wheel 714 is disposed at a first position pivoted in one direction in a state in which the winding stem 310 is disposed at 1 stage. The date corrector setting pinion 716 is comprised not to be brought in mesh with the inner teeth portion 720*a* of the date wheel 720 when the date corrector setting indicator 714 is disposed at a second position pivoted to other direction. The date corrector setting transmission wheel A708 is comprised to rotate via the clutch wheel 462 and the setting wheel 464 when the setting stem 360 is rotated in a state in which the winding stem 310 is disposed at 1 stage. Under the state, the inner teeth portion 720*a* of the date indicator 720 is comprised to rotate by the date corrector setting pinion 716 by rotating the date corrector setting wheel 714 and the date corrector setting pinion 716 by rotation of the date corrector setting transmission wheel A708 via rotation of the date corrector setting transmission wheel B.

Figure 14:
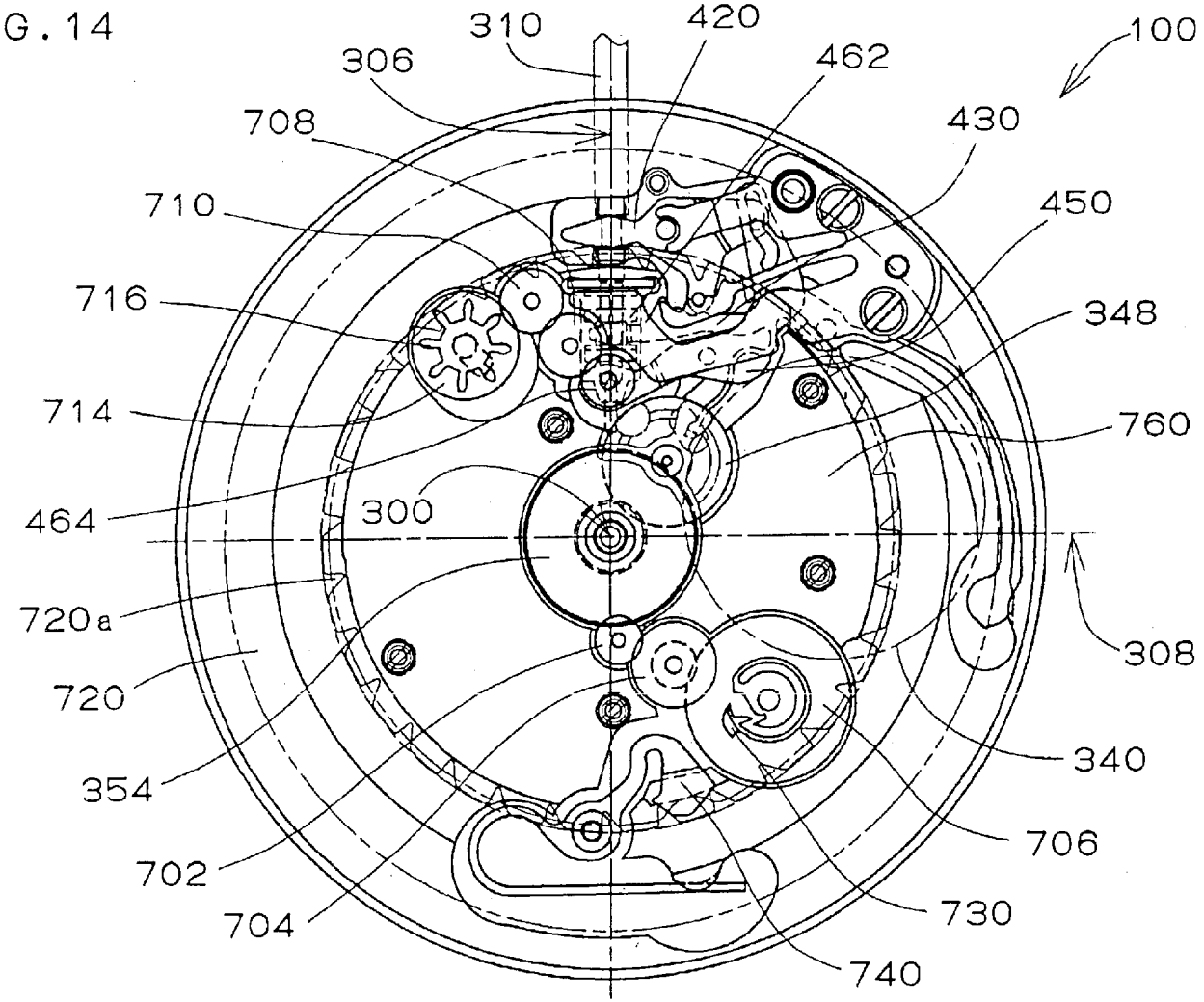
FIG. 14 is a plane view showing an outline shape of the back side of the movement in a state in which the winding stem is disposed at 1 stage to start correcting the date indicator according to the embodiment of the self-winding timepiece of the invention.
Figure 15:
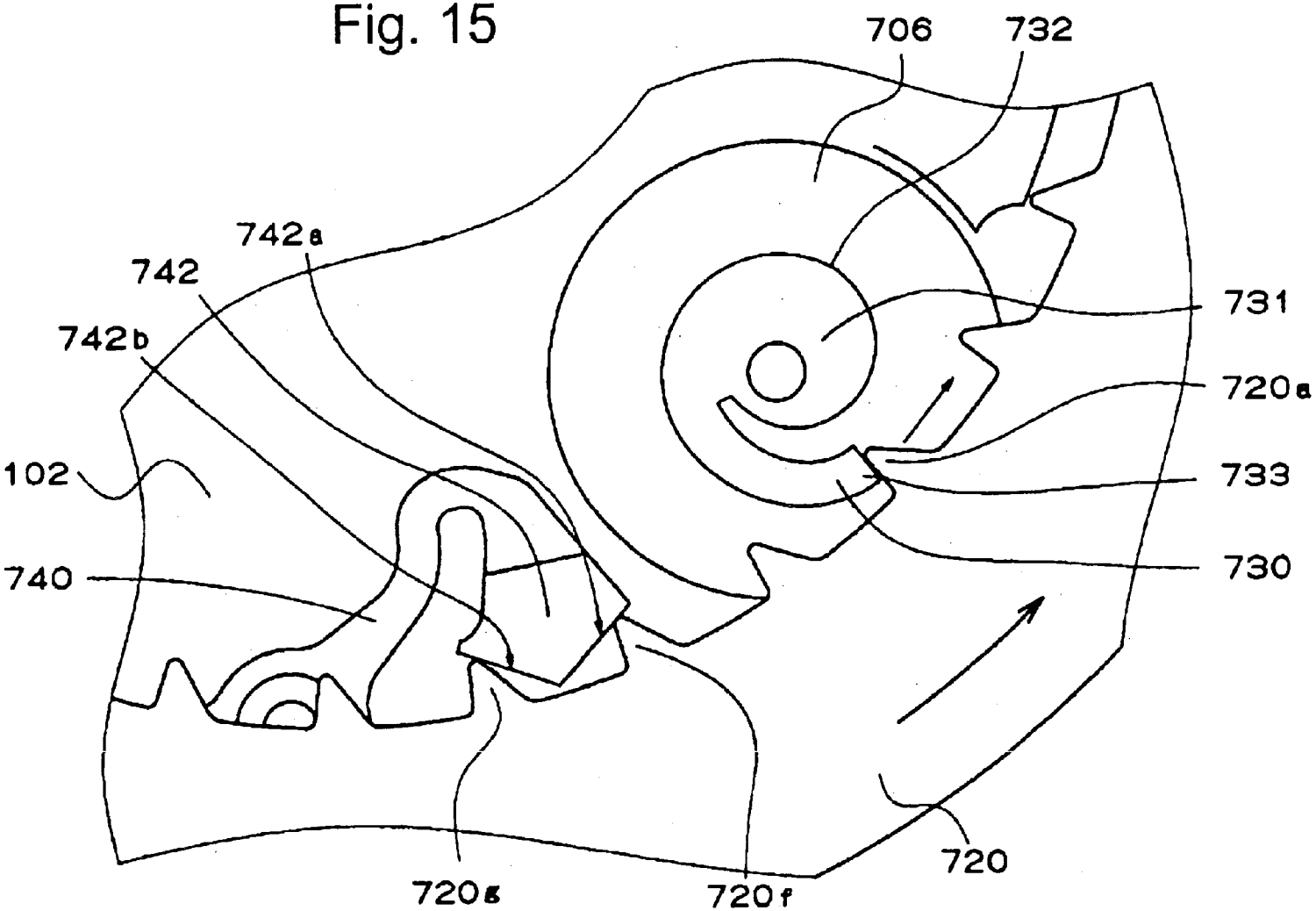
FIG. 15 is a partial plane view showing a date indicator driving finger and a date indicator in a state of starting to feed a date indicator according to the embodiment of the self-winding timepiece of the invention.

In reference to FIG. 14 and FIG. 15, a date jumper 740 is provided at the second region 302 and the third region 303 on the side of the dial 104 of the main plate 102. The date jumper 740 includes a base portion 741, a date indicator setting portion 742, and a date jumper spring portion 744. A hole provided at the base portion 741 is integrated to a date jumper pin provided at the main plate 102. A center of the hole provided at the base portion 741 comprises a rotating center 740*c* of the date jumper 740. The date wheel setting portion 742 of the date jumper 740 is engaged with the inner teeth portion 720*a* of the date wheel 720 to set rotation of the date wheel 720.

The date jumper spring portion 744 of the date jumper 740 is extended from the rotating center 740*c* of the date jumper 740 in a direction reverse to a direction of rotating the date indicator 720 with the date wheel setting portion 742 as a reference. By comprising the date jumper spring portion 744 in this way, the date indicator 720 can smoothly be rotated. The date jumper 740 is fabricated by an elastically deformable material. For example, it is preferable to fabricate the date jumper 740 by phosphor bronze or stainless steel. The rotating direction of the date indicator 720 is the counterclockwise direction. The date jumper 740 comprises date indicator setting means for setting the date indicator 720.

The date jumper 740 may be formed integrally with a date indicator holder 760 or the date jumper 740 may be formed separately from the date indicator holder 760. When the date indicator holder 760 is integrally formed with the date jumper 740, the date indicator holder 760 is fabricated by an elastically deformable material. In this case, it is preferable to fabricate the date indicator holder 760 by, for example, phosphor bronze or stainless steel.

The rotating center of the date corrector setting transmission wheel A708 is disposed in the first region 301. The rotating center of the date corrector setting transmission wheel B710 is disposed in the first region 301. The rotating center of the date corrector setting transmission wheel B710 is disposed in the first region 301. The setting portion 742 of the date jumper 740 for setting the date indicator 720 is disposed in the third region 303. The rotating center of the date indicator driving wheel 706 is disposed in the third region 303. Also the rotating center of the date indicator driving finger 730 is disposed in the third region 303.

The date indicator driving wheel 706 includes a date indicator driving wheel portion rotated based on rotation of the hour wheel 354 and a date indicator driving shaft portion (not illustrated) provided at a center of a face of the date indicator driving wheel portion on a side of the main plate 102. The date indicator driving shaft portion is rotatably integrated to a hole for integrating the date indicator driving wheel. A portion of the date indicator holder 760 includes a date indicator driving wheel holding portion for holding at least a portion of the date indicator driving wheel 706 rotatably at the main plate 102. By the structure, the date indicator driving wheel 706 can be held at the main plate 102. It is preferable to fabricate the date indicator driving wheel 706 by plastic such as polyacetal. Thereby, fabrication of the date indicator driving wheel 706 is facilitated, further, the date indicator driving wheel 706 can smoothly be rotated. By a plurality of date wheel holding screws 780, the date wheel holder 760 is fixed to the main plate 102. It is preferable to provide three pieces or more of the date wheel holding screws 780.

The date indicator driving finger 730 includes a central portion 731 integrally provided with the date indicator driving wheel 706, a spring portion 732 in a shape of a circular arc extended from the central portion 731 and a date indicator feeding portion 733 to rotate the date indicator 720 and the date indicator feeding portion 733 is provided at a front end of the spring portion 732. As shown by an arrow mark in FIG. 15, the date indicator 720 is comprised to rotate in the counterclockwise direction. Similarly, as shown by an arrow mark in FIG. 15, also the date indicator driving wheel 706 is comprised to rotate in the counterclockwise direction. FIG. 15 shows a state in which the date indicator feeding portion 733 of the date indicator driving finger 730 is rotated along with the date indicator driving wheel 706 is are just brought into contact with the inner teeth portion 720*a* of the date wheel 720. The inner teeth portion 720*a* of the date wheel 720 includes 31 pieces of triangular teeth.

The date wheel setting portion 742 of the date jumper. 740 includes a first setting portion 742*a* and a second setting portion 742*b*. In a state shown in FIG. 15, the first setting portion 742*a* is brought into contact with a circular arc of a tooth tip of a first tooth 720*f* in the inner teeth portion 720*a* of the date indicator 720 and the second setting portion 742*b* is brought into contact with a circular arc of a tooth tip of a second tooth 720*g* in the inner teeth portion 720*a* of the date wheel 720.

(9) Operation of Calendar Apparatus

Next, operation of the calendar apparatus of the self-winding timepiece of the invention will be explained.

(9.1) Date Indicator Feeding

First, operation of date indicator feeding of the self-winding timepiece of the invention will be explained. In reference to FIG. 14 and FIG. 15, the hour wheel 354 is rotated by one rotation in 12 hours based on rotation of the top train wheel. The intermediate date indicator driving wheel A702 is rotated based on rotation of the hour wheel 354. The intermediate date indicator driving wheel B704 is rotated based on rotation of the intermediate date indicator driving wheel A702. The date indicator driving wheel 706 is rotated by one rotation in 24 hours based on rotation of the intermediate date indicator driving wheel B704. By rotating the date indicator driving finger 703 integral with the date indicator driving wheel 706, the date indicator 720 can be rotated by once a day, or by an amount of one date. The position of the date indicator 720 in the rotating direction is set by the date jumper 740.

In reference to FIG. 15, when the date indicator driving wheel 706 and the date indicator driving finger 730 are rotated further from the state shown in FIG. 15, the date indicator driving finger 730 can rotate the date indicator 720 by the amount of one date.

(9.2) Date Correction

Figure 16:
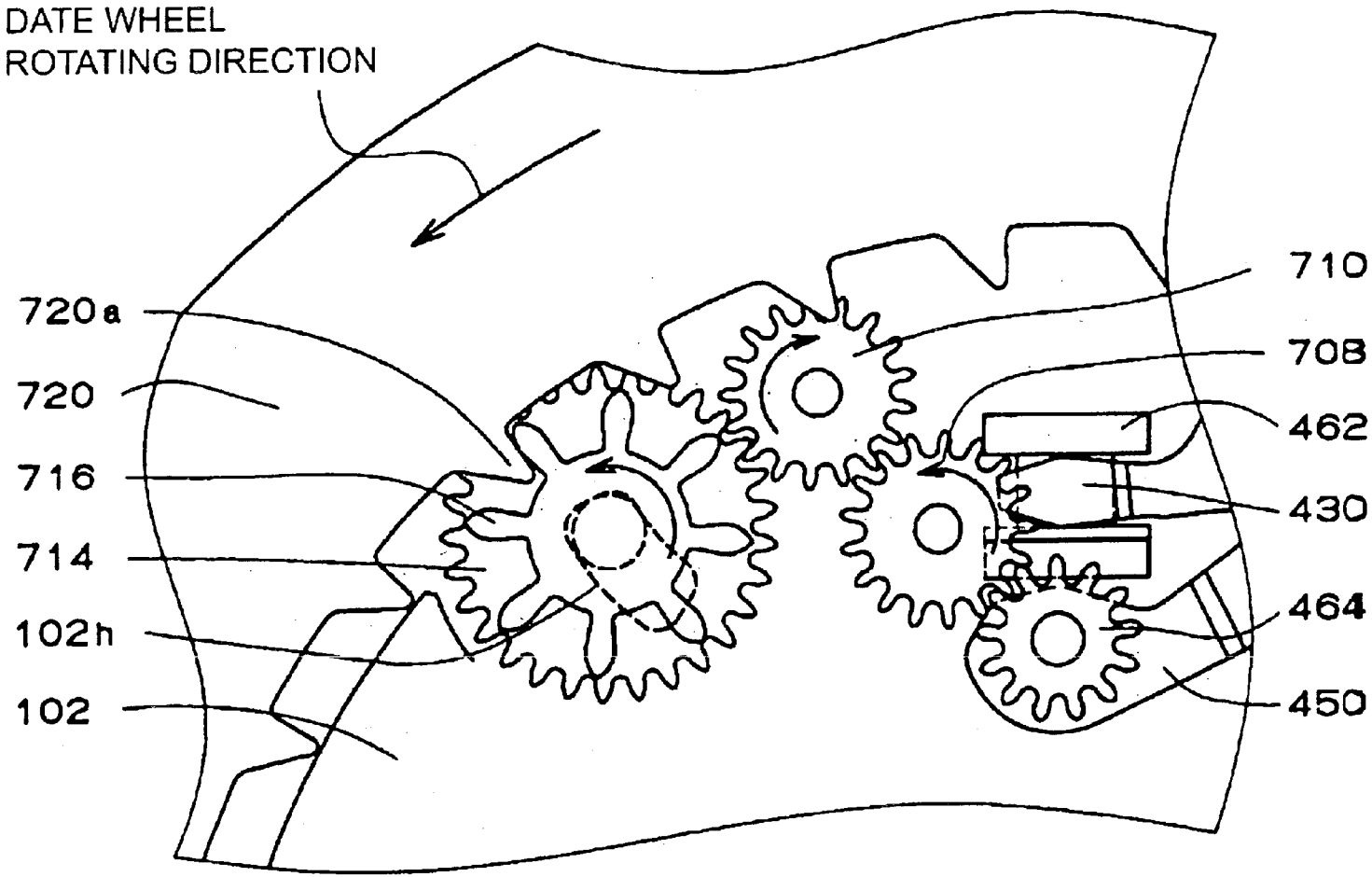
FIG. 16 is a partial plane view showing a date correcting mechanism in a state in which the winding stem is disposed at 1 stage to start correcting the date indicator according to the embodiment of the self-winding timepiece of the invention.

Next, operation of date correction of the self-winding timepiece of the invention will be explained. In reference to FIG. 14 and FIG. 16, when date correction is carried out, the winding stem 310 is pulled to 1 stage. Then, teeth of the clutch wheel 462 are brought in mesh with those of the setting wheel 464. When the winding stem 310 is rotated in a first direction in a state in which the winding stem 310 is set to 1 stage, the setting wheel 464 is rotated and the date correction setting transmission wheel B710 is rotated in the direction shown by the arrow mark via rotation of the date corrector setting transmission wheel A708. When the date corrector setting transmission wheel B710 is rotated in the direction shown by the arrow mark, the date corrector setting wheel 714 is moved to the first position pivoted in one direction (position at which date corrector setting transmission pinion 716 is brought in mesh with the inner teeth portion 720*a* of the date wheel 720). When the date corrector setting wheel 714 is disposed at the first position pivoted in one direction, the date corrector setting pinion 716 is brought in mesh with the inner teeth portion 720*a* of the date wheel 720. By rotating the winding: stem 310 in the first direction under the state, date correction can be carried out by rotating the date wheel 720 in the direction shown by the arrow mark.

When the winding stem 310 is rotated in a second direction opposed to the first direction in the state in which the winding stem 310 is set to 1 stage, the setting wheel 464 is rotated and the date corrector setting transmission wheel B710 is rotated in the direction opposed to the direction shown by the arrow mark via rotation of the date corrector setting transmission wheel A708. When the date corrector setting transmission wheel B710 is rotated in the direction opposed to the direction shown by the arrow mark, the date corrector setting wheel 714 is moved to the second position pivoted in other direction (position at which the date corrector setting pinion 716 is not brought in mesh with the inner teeth portion 720*a* of the date wheel 720). Even when the winding stem 310 is rotated in the second direction under the state, under the state, the date indicator 720 is not rotated and date correction cannot be carried out.

The date corrector setting transmission wheel A708 is brought in mesh with the date corrector setting transmission wheel B710. The date corrector setting transmission wheel B710 is brought in mesh with the date corrector setting wheel 714. The date corrector setting wheel 714 is pivotably integrated to the circular arc long hole 102*h* of the main plate 102. The date corrector setting pinion 716 is provided integrally with the date corrector setting wheel 714. In reference to FIG. 14 and FIG. 15, when the date corrector setting wheel 714 is disposed at the second position pivoted in other direction, the date corrector setting pinion 716 is comprised not to be brought in mesh with the inner teeth portion 720*a* of the date wheel 720. When the winding stem 310 is rotated in the state in which the winding stem 310 is set to 1 stage, the date corrector setting transmission wheel A708 is comprised to rotate via the clutch wheel 462 and the setting wheel 464. The inner teeth portion 720*a* of the date wheel 720 is comprised to rotate by the date corrector setting pinion 716 by rotating the date corrector setting wheel 714 and the date corrector setting pinion 716 via rotation of the date corrector setting transmission wheel B by rotation of the date corrector setting transmission wheel A708 under the state.

(10) Arrangement of Part on Top Side of Movement

Figure 7:
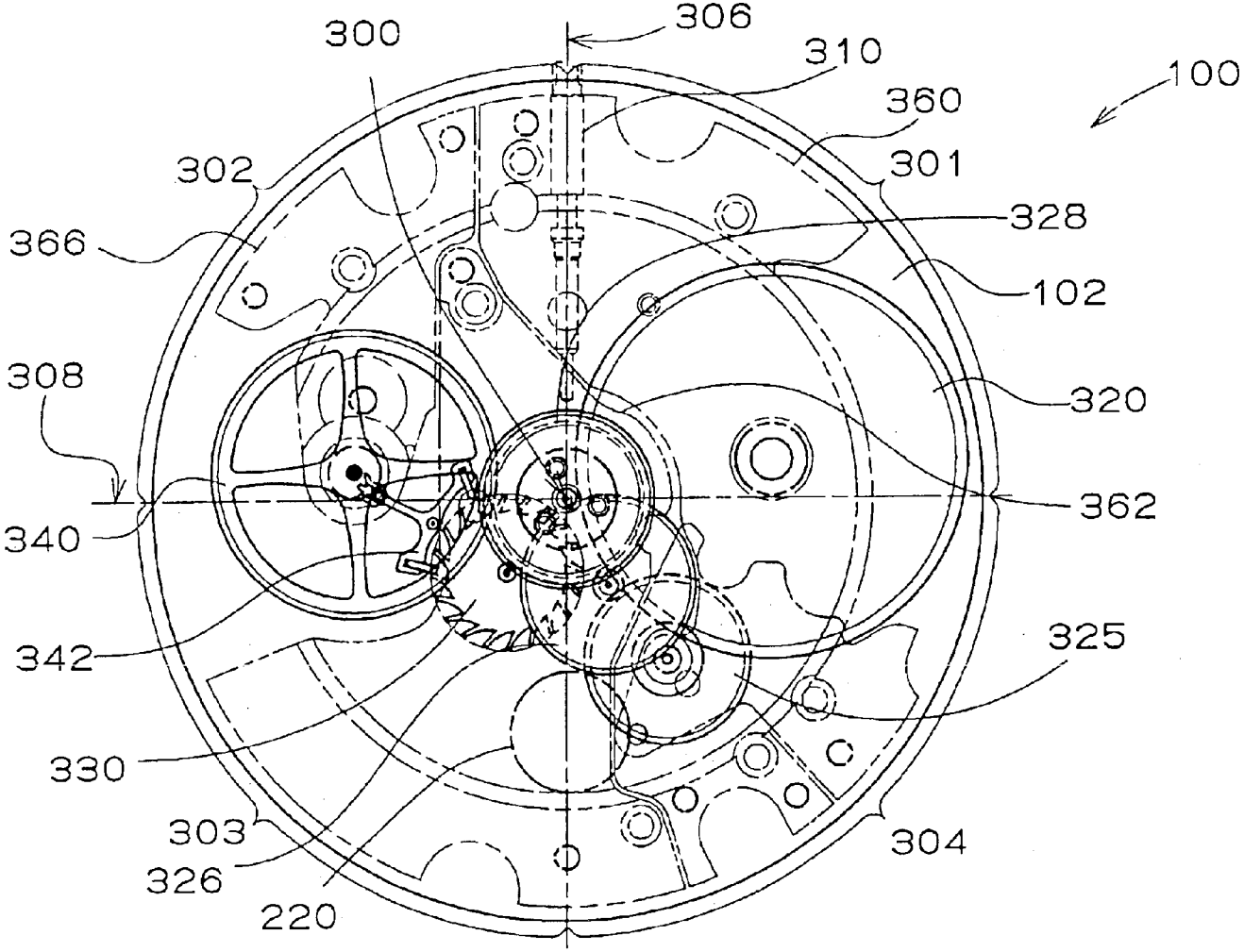
FIG. 7 is a plane view showing an outline shape of a top side of a movement according to the embodiment of the self-winding timepiece of the invention (in FIG. 7, portions of parts of the self-winding mechanism and the like are omitted and bridge members are indicated by imaginary lines)
Figure 8:
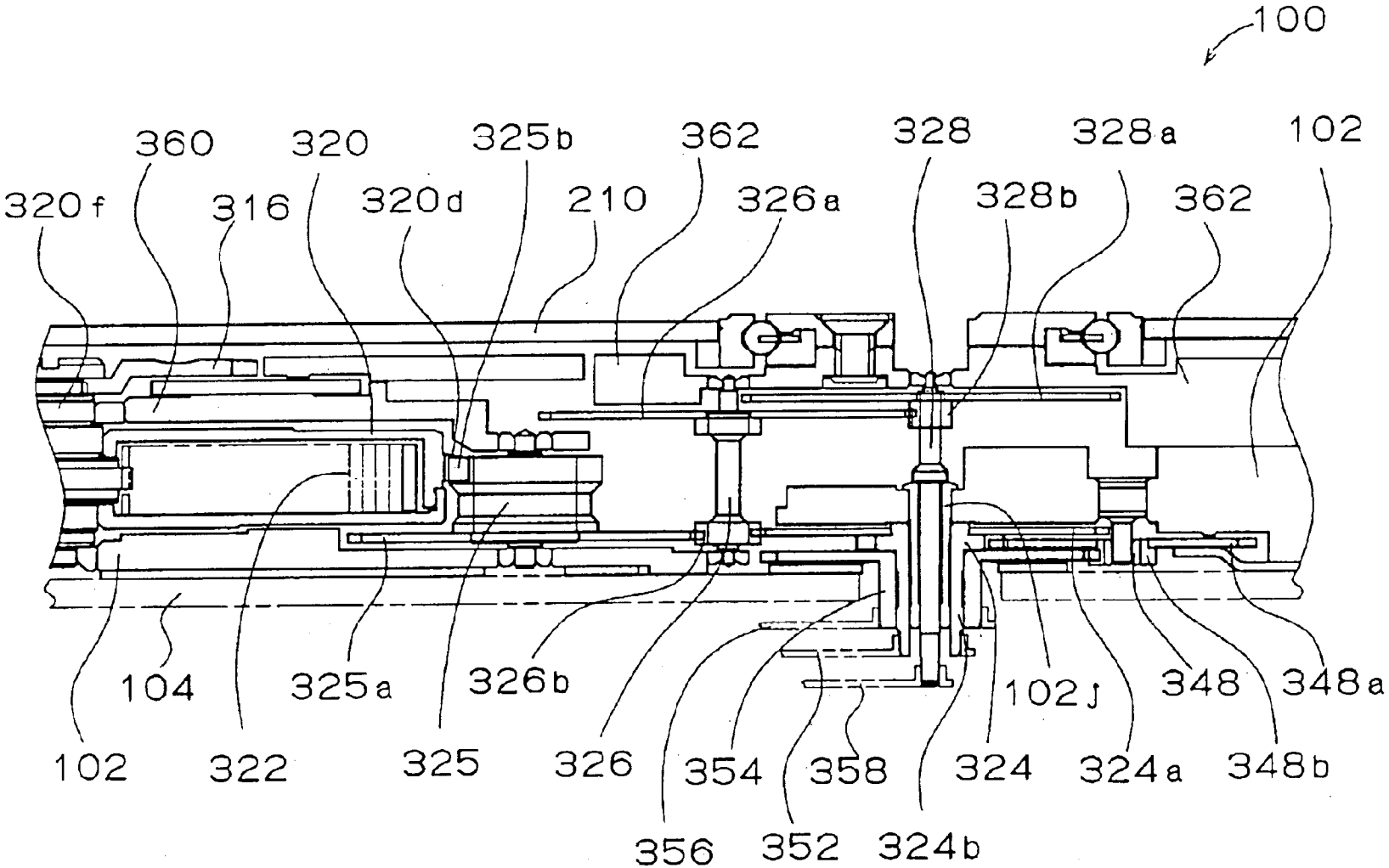
FIG. 8 is an outline partially sectional view showing a portion from a movement barrel complete to an hour wheel according to the embodiment of the self-winding timepiece of the invention.
Figure 9:
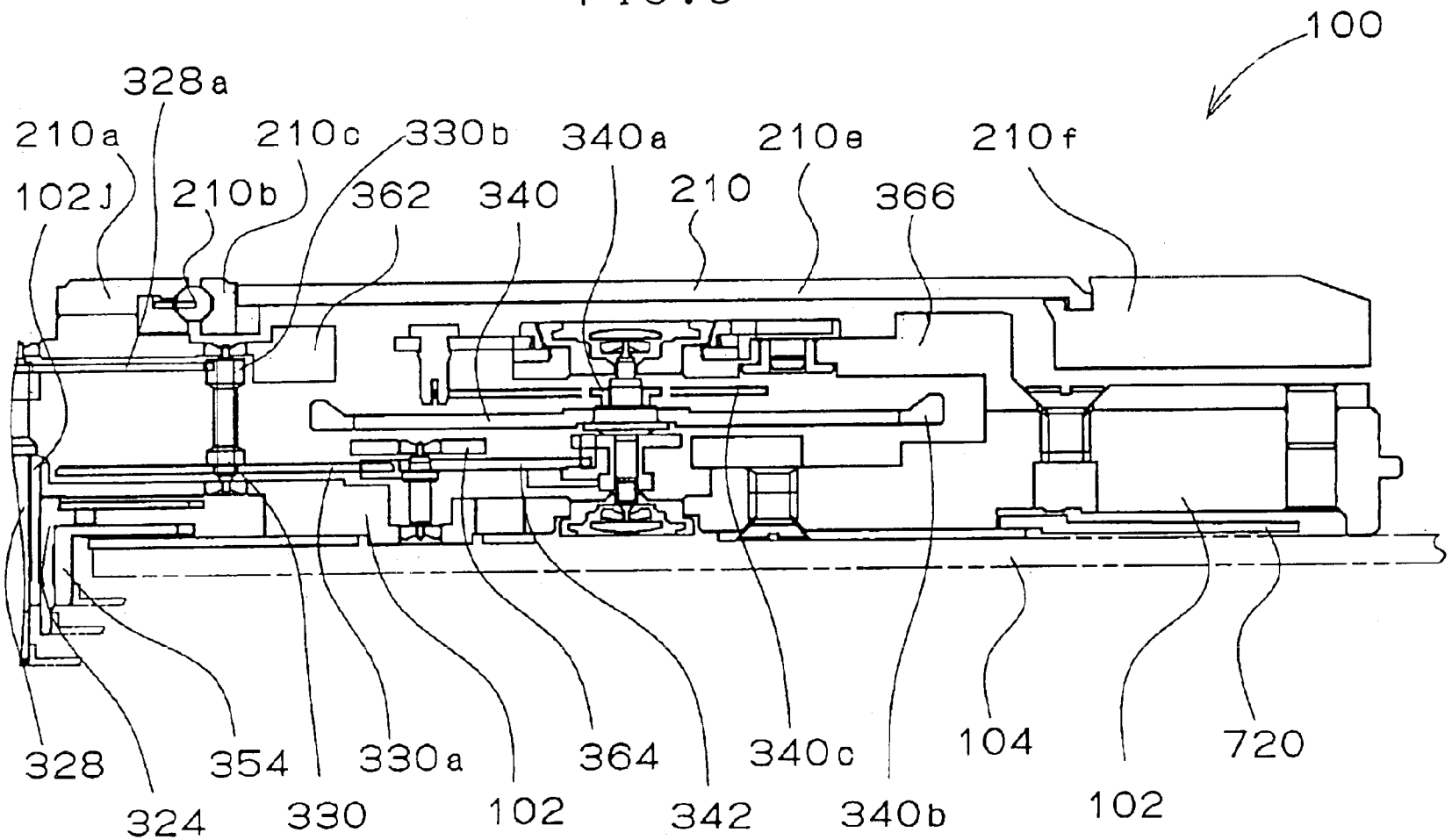
FIG. 9 is an outline partially sectional view showing a portion from an escape wheel & pinion to a balance with hairspring according to the embodiment of the self-winding timepiece of the invention.

In FIG. 1 and FIG. 7, at the main plate 102, there are defined the main plate reference vertical axis line 306 passing the rotating center 300 of the minute indicator 324 and substantially in parallel with the center axis line of the winding stem 310 and the main plate reference horizontal axis line 308 passing the rotating center 300 of the minute indicator 324 and orthogonal to the main plate reference vertical axis line 306. The main plate 102 is provided with the first region 301 disposed on one side of the main plate reference vertical axis line 306 and on the side of the main plate reference horizontal axis line 308 proximate to the winding stem 310. The main plate 102 is provided with the second region 302 disposed on other side of the main plate reference vertical axis line 306 and on the side of the main plate reference horizontal axis line 308 proximate to the winding stem 310. The main plate 102 is provided with the third region 303 disposed on the other side of the main plate reference vertical axis line 306 at which the second region 302 is present and on the side of the main plate reference horizontal axis line 308 remote from the winding stem 310. The main plate 102 is provided with the fourth region 304 disposed on the one side of the main plate reference vertical axis line 306 at which the first region is present and on the side of the main plate reference horizontal axis line 308 remote from the winding stem 310.

Although in FIG. 7, the first region 301 and the fourth region 304 are disposed on the right side of the main plate reference vertical axis line 306, the regions may be defined to dispose on the left side of the main plate reference vertical axis line 306. Naturally, in this case, the second region 302 and the third region 303 are defined to dispose on the right side of the main plate reference vertical axis line 306.

The rotating center of the movement barrel complete 320 is disposed in the first region 301. By comprising in this way, the mainspring having large torque and capable of continuing for a long period of time can effectively be arranged on the top side of the movement. The rotational center of the movement barrel complete 320 may be disposed in the fourth region 304. That is, although the rotational center of the movement barrel complete 320 may be disposed in the first region or may be disposed in the fourth region 304, the movement barrel complete 320 is arranged to overlap the main plate reference horizontal axis line 308 between the first region 301 and the fourth region 304.

The rotating center of the escape wheel & pinion 330 is disposed in the third region 303. The pivoting center of the pallet fork 342 is disposed in the third region 303. The rotating center of the balance with hairspring 340 is disposed in the second region 302. By comprising in this way, the large movement barrel complete can be used. Further, by the constitution, the balance with hairspring 340 having large moment of inertia having further excellent time accuracy can effectively be arranged on the top side of the movement.

The rotating center of the balance with hairspring 340 may be disposed in the third region 303. That is, although the rotating center of the balance with hairspring 340 may be disposed in the third region 303 or may be disposed in the second region 302, the balance with hairspring 340 is arranged to overlap the main plate reference horizontal axis line 308 between the second region 302 and the third region 303. By comprising in this way, the large third wheel & pinion 326 can effectively be arranged on the top side of the movement.

The rotating center of the switching transmission wheel 220 is disposed in the fourth region 304. However, the rotating center of the switching transmission wheel 220 may be disposed in the third region 303. That is, although the rotating center of the switching transmission wheel 220 may be disposed in the third region 303 or may be disposed in the fourth region 304, the switching transmission wheel 220 is arranged to overlap the main plate reference vertical axis line 306 between the third region 303 and the fourth region 304. By comprising in this way, on the top side of the movement, the switching transmission wheel 220 can effectively be arranged not to interfere with the top train wheel.

The rotating center of the second wheel & pinion 328 operated for indicating second is the same as the rotating center 300 of the minute indicator 324. That is, the embodiment of the self-winding timepiece of the invention shows a center three hands wrist watch. The rotating center of the second wheel & pinion 328 may be disposed at a position separate from the rotating center 300 of the minute indicator 324. The third wheel & pinion 326 transmits rotation of the center wheel & pinion 325 to the second wheel & pinion 328. The rotating center of the center wheel & pinion 325 is disposed in the fourth region 304. The rotating center of the third wheel & pinion 326 is disposed in the fourth region 304. By comprising in this way, the large third wheel & pinion 326 can effectively be arranged on the top side of the movement.

Here, a number of train wheels is not restricted to that in the above-described but one or more of transmission wheels may further be added. Further, the pivoting center 420*c* of the setting lever 420 is comprised to dispose in the second region 302 and the pivoting center 430*c* of the yoke 430 is comprised to dispose in the second region 302.

A portion of the train wheel setting portion 470*b* of the train wheel setting lever 470 for setting the balance wheel 340*b* is disposed in the second region 302. The rotating center of the train wheel setting lever 470 is disposed in the second region 302. By the constitution, the thin and small-sized train wheel setting apparatus can efficiently be arranged in the self-winding timepiece.

Although it is preferable to arrange the above-described respective parts to comprise the structure shown in FIG. 7, the above-described respective parts may be arranged to comprise a structure of mirror symmetry with a structure shown in FIG. 7 relative to the main plate reference vertical axis line 306. For example, it may be comprised such that the rotating center of the movement barrel complete 320 is disposed in the second region 302, the rotating center of the escape wheel & pinion 330 is disposed in the fourth region 304, the pivoting center of the pallet fork 342 is disposed in the fourth region 304 and the rotating center of the balance with hairspring 340 is disposed in the first region 301. That is, according to the structure in mirror symmetry with the structure shown in FIG. 7, the rotating center of the balance with hairspring 340 may be disposed in the first region 301 or may be disposed in the fourth region 304, however, the balance with hairspring 340 is arranged to overlap the main plate reference horizontal axis line 308 between the first region 301 and the fourth region 304. Further, according to the structure in mirror symmetry with the structure shown in FIG. 7, it is comprised that the pivoting center 420*c* of the setting lever 420 is disposed in the first region 301 and the pivoting center 430*c* of the yoke 430 is disposed in the first region 301. According to the structure in mirror symmetry with the structure shown in FIG. 7, the portion of the train wheel setting portion 470*b* of the train wheel setting lever 470 for setting the balance with hairspring 340*b* is disposed in the first region 301 and the rotating center of the train wheel setting lever 470 is disposed in the first region 301. By the constitution, the thin and small-sized train wheel setting apparatus can efficiently be arranged in the self-winding timepiece.

(11) Operation of Train Wheel Apparatus

Next, operation of the train wheel apparatus of the self-winding timepiece of the invention will be explained. In reference to FIG. 7 through FIG. 9, by force of the main-spring (not illustrated), the movement barrel complete 320 is rotated. The center wheel & pinion 325 is rotated by rotation of the movement barrel complete 320. The third wheel & pinion 326 is rotated by rotation of the center wheel & pinion 325. The second wheel & pinion 328 is rotated by rotation of the third wheel & pinion 326. Further, the minute indicator 324 is simultaneously rotated by rotation of the third wheel & pinion 326. The minute wheel 348 is rotated by rotation of the minute indicator 324. The hour wheel 354 is rotated by rotation of the minute wheel 348. Rotating speeds of the respective train wheels are controlled by operation of the balance with hairspring 340, the pallet fork 342 and the escape wheel & pinion 330. As a result, the second wheel & pinion 328 is rotated by one rotation in 1 minute. The minute indicator 324 is rotated by one rotation in 1 hour. The hour wheel 354 is rotated by one rotation in 12 hours.

"Second" is indicated by the second hand (not illustrated) attached to the second wheel & pinion 328. "Minute" is indicated by the minute hand (not illustrated) attached to the hour pinion 324*a*. "Hour" is indicated by the hour hand (not illustrated) attached to the hour wheel 354. That is, the second wheel & pinion 328, the minute indicator 324 and the hour wheel 354 comprise indicating wheels for indicating time information. Time is read by graduation or the like of the dial 104.

(12) Operation of Switching Apparatus

Next, operation of the switching apparatus of the self-winding timepiece of the invention will be explained. In reference to FIG. 13, the setting lever 420, the yoke 430, the yoke holder 440 and the operating lever 450 are integrated to the back side of the main plate 102. The setting wheel 464 is rotatably attached to the operating lever 450. The clutch wheel 462 is coaxially attached to the winding stem 310. The hat-like portion 442 of the yoke holder 440 is engaged with the positioning pin of the setting lever 420 to position the setting lever 420 and set switching weight of the winding stem 310. By rotating the setting lever 420, the operating lever positioning pin is moved in the operating lever guide hole. Thereby, when the winding stem 310 is set from 0 stage to 1 stage, the operating lever 450 is not rotated and when the winding stem 310 is set from 1 stage to 2 stage, the operating lever 450 is rotated.

In reference to FIG. 13, even when the winding stem 310 is rotated in the state in which the winding stem 310 is set to 0 stage, the clutch wheel 462 is not rotated and the clutch wheel 462 is not brought in mesh with the setting wheel 464. In reference to FIG. 14, when the winding stem 310 is rotated in the state in which the winding stem 310 is set to 1 stage, the clutch wheel 462 is rotated, the clutch wheel 462 is brought in mesh with the setting wheel 464 and when the winding stem 310 is rotated, the setting wheel 464 is rotated via rotation of the clutch wheel 462. Although not illustrated, when the winding stem 310 is rotated in the state in which the winding stem 310 is set to 2 stage, the clutch wheel 462 is rotated. Further, when the winding stem 310 is set from 1 stage to 2 stage, by rotating the operating lever 450, the clutch wheel 462 is brought in mesh with the setting wheel 464 and the setting wheel 464 is brought in mesh with the minute wheel 348. When the winding stem 310 is rotated under the state, the minute wheel 348 can be rotated via rotation of the clutch wheel 462 and the setting wheel 464. Therefore, in the state in which the winding stem 310 is set to 2 stage, by rotating the winding stem 310, the hands of the timepiece can be set by rotating the hour wheel 354 and the minute indicator 324 via rotation of the clutch wheel 462, the setting wheel 464 and the minute wheel 348.

(13) Operation of Train Wheel Setting Apparatus

Next, operation of the train wheel setting apparatus of the self-winding timepiece of the invention will be explained. In reference to FIG. 17 through FIG. 19, the train wheel setting lever 470 is arranged rotatably by the main plate 102 on the back side of the movement 100 in the state in which the winding stem 310 is set to 0 stage. The train wheel setting portion 470*b* of the train wheel setting lever 470 is extended to the topside of the main plate 102 by penetrating the window portion provided at the main plate 102. In the state in which the winding stem 310 is set to 0 stage, a clearance is present between the train wheel setting portion 470*b* of the train wheel setting lever 470 and the balance wheel 340*b* of the balance with hairspring 340.

When the winding stem 310 is set from 0 stage to 1 stage, the train wheel setting lever 470 is not rotated. When the winding stem 310 is set from 1 stage to 2 stage, the operating lever positioning pin 420*f* of the setting lever 420 is rotated and the train wheel setting lever 470 is pushed by the operating positioning pin. That is, by rotating the setting lever 420, the operating lever positioning pin 420*f* pushes the train wheel setting lever 470 and the train wheel setting lever 470 is rotated in the first direction (in FIG. 17, clockwise direction: in FIG. 18, counterclockwise direction). Thereby, the train wheel setting portion 470*b* of the train wheel setting lever 470 sets the balance wheel 340*b*. Then, the balance wheel 340*b* stops rotating movement.

When the winding stem 310 is set from 2 stage to 1 stage (or 0 stage) by rotating the setting lever 420, the operating lever positioning pin 420*f* of the setting lever 420 is rotated and the train wheel setting lever 470 is rotated in the second direction (in FIG. 17, counterclockwise direction: in FIG. 18, clockwise direction) reverse to the first direction by elastic force of the rotating spring portion 470*f*. Thereby, the train wheel setting portion 470*b* of the train wheel setting lever 470 is separated from the balance wheel 340*b*. Thereby, the balance wheel 340*b* can start rotating movement.

(14) Example of Other Structure of Self-winding Timepiece of the Invention

Although an explanation has been given of a mechanical time timepiece, a self-winding wrist watch, a center three hands type timepiece, a timepiece having only a calendar mechanism and a timepiece of structure of 2 stage pull winding stem according to the embodiment of the self-winding timepiece of the invention, the invention is applicable to timepieces having structures shown below and the like.

(a) Two Hands Type Timepiece

In the above-described explanation, the self-winding timepiece of the invention can be comprised to delete the second hand and include only the hour hand and the minute hand.

(b) Timepiece Having Week Indication

In the above-described explanation, the self-winding timepiece of the invention can be comprised to further include a day indicating mechanism. In this case, the self-winding timepiece of the invention can be comprised to further include a day feeding finger rotated by one rotation per day based on rotation of the date indicator driving wheel 706 and a day wheel rotated by (360/7) degrees per day based on rotation of the day feeding finger. Further, when needed, the self-winding timepiece of the invention may be comprised to include a day correcting mechanism for correcting the day wheel via rotation of a day corrector transmission wheel based on rotation of the date corrector setting wheel 714.

(c) Timepiece of Structure of 1 Stage Pull Winding Stem

Although according to the above-described explanation, an explanation has been given of the self-winding timepiece of the invention as the timepiece of a structure of a 2 stage pull winding stem, when the date correcting mechanism is deleted, or when other structure of the date correcting mechanism (for example, winding stem push type date correcting mechanism) is used, the self-winding timepiece of the invention can be comprised such that the hands of the timepiece are set by rotating the hour wheel 354 and the minute indicator 324 via rotation of the clutch wheel 462, the setting wheel 464 and the minute wheel 348 by rotating the winding stem 310 in the state in which the winding stem 310 is set to 1 stage. In this case, the train wheel setting lever can be comprised to operate in the state in which the winding stem 310 is set to 1 stage.

A self-winding timepiece having simple shapes of parts and facilitating to fabricate, integrate and adjust the parts can be realized by the invention.

Further, according to the invention, in a self-winding timepiece, a train wheel apparatus, an escapement speed control apparatus, a switching apparatus, a self-winding mechanism and a calendar mechanism are arranged without wasting a space and therefore, a small-sized and thin self-winding timepiece can be realized.

A train wheel setting apparatus for setting a balance with hairspring can efficiently be arranged at a movement by the invention.

What is claimed is:

1. A self-winding timepiece characterized in a self-winding timepiece including a main plate comprising a base plate of a movement, a time indicating wheel rotated with a rotating center thereof disposed at the main plate for indicating time information, a winding stem and a clutch wheel for correcting the time information, a switching apparatus for determining a position in an axis line direction of the winding stem, and a dial for indicating the time information along with the time indicating wheel:

wherein when a main plate reference vertical axis line passing the rotating center of the time indicating wheel and substantially in parallel with a center axis line of the winding stem and a main plate reference horizontal axis line passing the rotating center of the time indicating wheel and orthogonal to the main plate reference orthogonal axis line are defined at the main plate, the main plate is provided with a first region disposed on one side of the main plate reference orthogonal axis line and on a side of the main plate reference horizontal axis line proximate to the winding stem, a second region disposed on other side of the main plate reference vertical axis line and on the side of the main plate reference horizontal axis line proximate to the winding stem, a third region disposed on the other side of the main plate reference vertical axis line at which the second region is present and on a side of the main plate reference horizontal axis line remote from the winding stem, and a fourth region disposed on the one side of the main plate reference vertical axis line at which the first region is present and on the side of the main plate reference horizontal axis line remote from the winding stem, further comprising:

a movement barrel complete arranged on a side of the main plate opposed to the dial and arranged to overlap the main plate reference horizontal axis line between the first region and the fourth region;

a balance with hairspring arranged on the side of the main plate opposed to the dial and arranged to overlap the main plate reference horizontal axis between the second region and the third region; and a self-winding mechanism arranged on the side of the main plate opposed to the dial for winding a mainspring of the movement barrel complete; and wherein the switching apparatus is arranged on a side of the main plate at which the dial is present, a train wheel setting apparatus operated by operating the switching apparatus is arranged on the side of the main plate at which the dial is present, the train wheel setting apparatus includes a train wheel setting portion for setting the balance with hairspring by penetrating the main plate, and on the side of the main plate opposed to the dial, a portion of the train wheel setting portion of the train wheel setting apparatus for setting the balance with hairspring is disposed in the second region and on the side of the main plate at which the dial is present, a rotating center of the train wheel setting apparatus is disposed in the second region.

2. A self-winding timepiece according to claim 1, wherein the movement barrel complete including the mainspring comprising a power source of the timepiece is arranged to overlap the main plate reference horizontal axis line between the first region (301) and the fourth region.

3. A self-winding timepiece according to claim 2, further comprising:

a center wheel & pinion arranged on the side of the main plate opposed to the dial and rotated by rotation of the movement barrel complete;

a third wheel & pinion arranged on the side of the main plate opposed to the dial and rotated by rotation of the center wheel & pinion; and a second wheel & pinion arranged on the side of the main plate opposed to the dial and rotated by rotation of the third wheel & pinion and operated to indicate a second;

wherein the time indicating wheel is arranged on the side of the main plate at which the dial is present and comprised to rotate by the rotation of the third wheel & pinion, and a rotating center of the center wheel & pinion and a rotating center of the third wheel & pinion are disposed in the fourth region.

4. A self-winding timepiece according to claim 1, further comprising:

an escape wheel & pinion arranged on the side of the main plate opposed to the dial and having a rotating center in the third region; and a pallet fork arranged on the side of the main plate opposed to the dial and having a pivoting center in the third region.

5. A self-winding timepiece according to claim 1, wherein the self-winding mechanism includes a switching transmission wheel comprised to input rotation in two directions of an oscillating weight and output rotation in one direction thereof and the switching transmission wheel is arranged to overlap the main plate reference vertical axis line between the third region and the fourth region.

* * * * *